US006814014B2

(12) United States Patent
Mamiya

(10) Patent No.: US 6,814,014 B2
(45) Date of Patent: Nov. 9, 2004

(54) SEWING APPARATUS AND SEWING CARTRIDGE

(75) Inventor: Toshiyuki Mamiya, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 206 days.

(21) Appl. No.: 09/989,398

(22) Filed: Nov. 21, 2001

(65) Prior Publication Data

US 2002/0029729 A1 Mar. 14, 2002

Related U.S. Application Data

(63) Continuation-in-part of application No. 09/897,600, filed on Jul. 3, 2001, now Pat. No. 6,712,014.

(30) Foreign Application Priority Data

| | | |
|---|---|---|
| Jul. 3, 2000 | (JP) | 2000-201244 |
| Jul. 3, 2000 | (JP) | 2000-201246 |
| Nov. 24, 2000 | (JP) | 2000-357426 |
| Nov. 27, 2000 | (JP) | 2000-360038 |
| May 16, 2001 | (JP) | 2001-146495 |

(51) Int. Cl.[7] ..... D05C 9/12

(52) U.S. Cl. ..... 112/102.5; 112/80.08; 112/236; 112/302

(58) Field of Search ..... 112/102.5, 470.06, 112/302, 270, 470.05, 80.08, 236, 235, 240

(56) References Cited

U.S. PATENT DOCUMENTS

| | | | | |
|---|---|---|---|---|
| 3,089,442 A | * | 5/1963 | Short | 112/80.08 |
| 4,183,313 A | | 1/1980 | Odermann et al. | |
| 4,230,055 A | * | 10/1980 | Kaempfer | 112/236 |
| 4,292,907 A | * | 10/1981 | Gilbride et al. | 112/236 |
| 4,319,532 A | * | 3/1982 | Fogarty et al. | 112/302 |
| 4,703,432 A | | 10/1987 | Muller | |
| 6,145,456 A | * | 11/2000 | Codos | 112/117 |
| 6,543,374 B2 | * | 4/2003 | Terao | 112/470.05 |

* cited by examiner

*Primary Examiner*—Peter Nerbun
(74) *Attorney, Agent, or Firm*—Oliff & Berridge, PLC

(57) ABSTRACT

A sewing apparatus includes a hollow needle that can pass through a work cloth, and a needle cover that has a passing hole through which the needle passes and holds the work cloth. The needle cover functions as a presser foot and holds at least a part of a thread between a previous stitch point where a stitch has been previously made and a succeeding stitch point where a stitch is to be currently made. Accordingly, sewing can be performed on the workpiece without use of a lower thread.

21 Claims, 31 Drawing Sheets

SEWING APPARATUS AND SEWING CARTRIDGE

This is a Continuation-in-Part of application Ser. No. 09/897,600 filed Jul. 3, 2001; now U.S. Pat. No. 6,712,014. The entire disclosure of the prior application(s) is hereby incorporated by reference herei in its entirety.

BACKGROUND OF THE INVENTION

1. Field of Invention

The invention relates to a sewing apparatus and a sewing cartridge. More particularly, the invention relates to a technique that causes a thread to remain in a workpiece by a thread holding force due to the elasticity of the workpiece in order to prevent stitches formed on the workpiece from unraveling.

2. Description of Related Art

Conventionally, a sewing apparatus such as a sewing machine includes a needle that has an upper thread and passes the upper thread into a work cloth, a thread take-up that tightens the upper thread, and a mechanism that drives the needle and the thread take-up. A thread loop that accommodates a lower thread in a bobbin and incorporates with the needle and the thread take-up to form an upper thread loop and interloops the upper thread and the lower thread into each other. A feed dog that feeds the work cloth, and a mechanism that drives the feed dog are also included. A sewing operation is performed by which the work cloth is fed by driving the needle and the thread take-up vertically.

A conventional home-use embroidery machine has an embroidery frame to which a work cloth is attached and a device for moving the embroidery frame in orthogonal directions (an X direction and a Y direction) in a horizontal plane, instead of the feed dog. The sewing operation is performed by which the embroidery frame is independently moved in the X direction and the Y direction, by a controller, based on embroidery data.

When a sewing operation is performed using an upper thread and a lower thread as in a conventional sewing apparatus, the thread loop taker, the driving device for the thread loop taker, and the like are needed. Accordingly, the structure of the conventional sewing apparatus becomes complicated. It is difficult to reduce size and weight of such a sewing apparatus. There has been proposed sewing equipment that performs a sewing operation using only the upper thread. However, the stitches are liable to unravel because the upper thread does not interloop the lower thread. Therefore, the stitches are far from perfect stitches and are not practical. When the sewing operation is performed using only the upper thread, so far, there has been no thought at all of using a work cloth having a special structure that prevents stitches and embroidery patterns from unraveling.

SUMMARY OF THE INVENTION

The invention provides a sewing apparatus where sewing is performed by causing a thread to remain in a workpiece. The sewing apparatus includes a needle that moves up and down to pass the thread into the workpiece, a workpiece moving device that relatively moves the workpiece with respect to the needle, and a holding member that holds at least a part of the thread connecting two consecutive stitch points in accordance with the relative movement between the needle and the workpiece.

When sewing is performed on the workpiece, the pressing member holds at least a part of the thread connecting two consecutive stitch points. The needle moves up and down to pass the thread into the workpiece, and the thread remains in the workpiece. Because the pressing member holds the thread, sewing can be performed on the workpiece without use of a lower thread or certain other components of conventional sewing apparatus.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A preferred embodiment of the invention will be described in detail with reference to the accompanying drawings.

Figure 1:
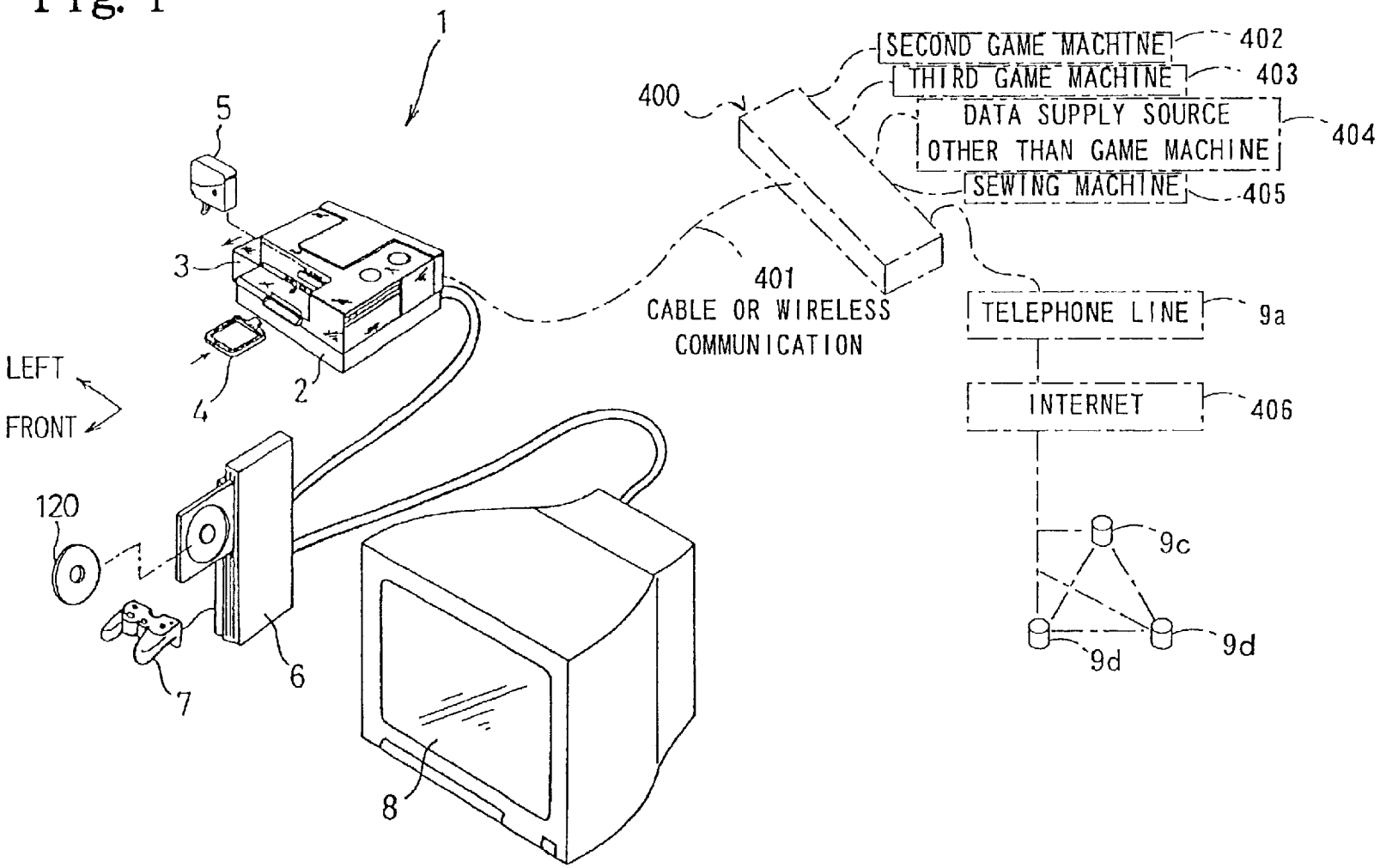
FIG. 1 is a perspective view of a sewing apparatus and a video game machine according to an embodiment of the invention.

As shown in FIG. 1, a sewing apparatus 1 is connected to a home video game machine 6 including a controller 7 via a cable. In the sewing apparatus 1, an embroidery pattern is selected and edited using the game machine 6 while the embroidery pattern is observed on a screen of a display 8. The selected/edited embroidery pattern can be embroidered on a work cloth.

Figure 2:
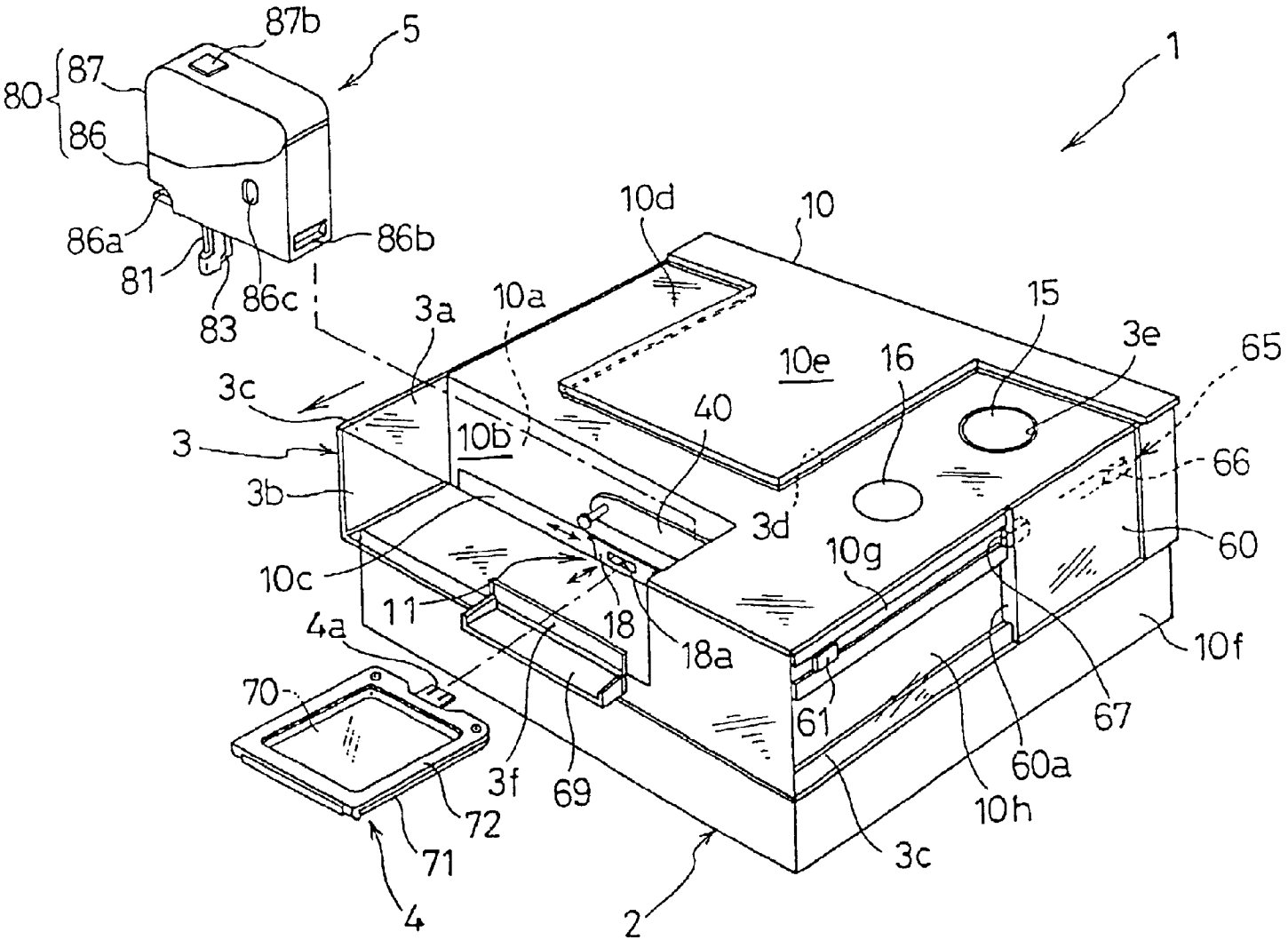
FIG. 2 is a perspective view of the sewing apparatus when a safety cover is in a storage position.
Figure 3:
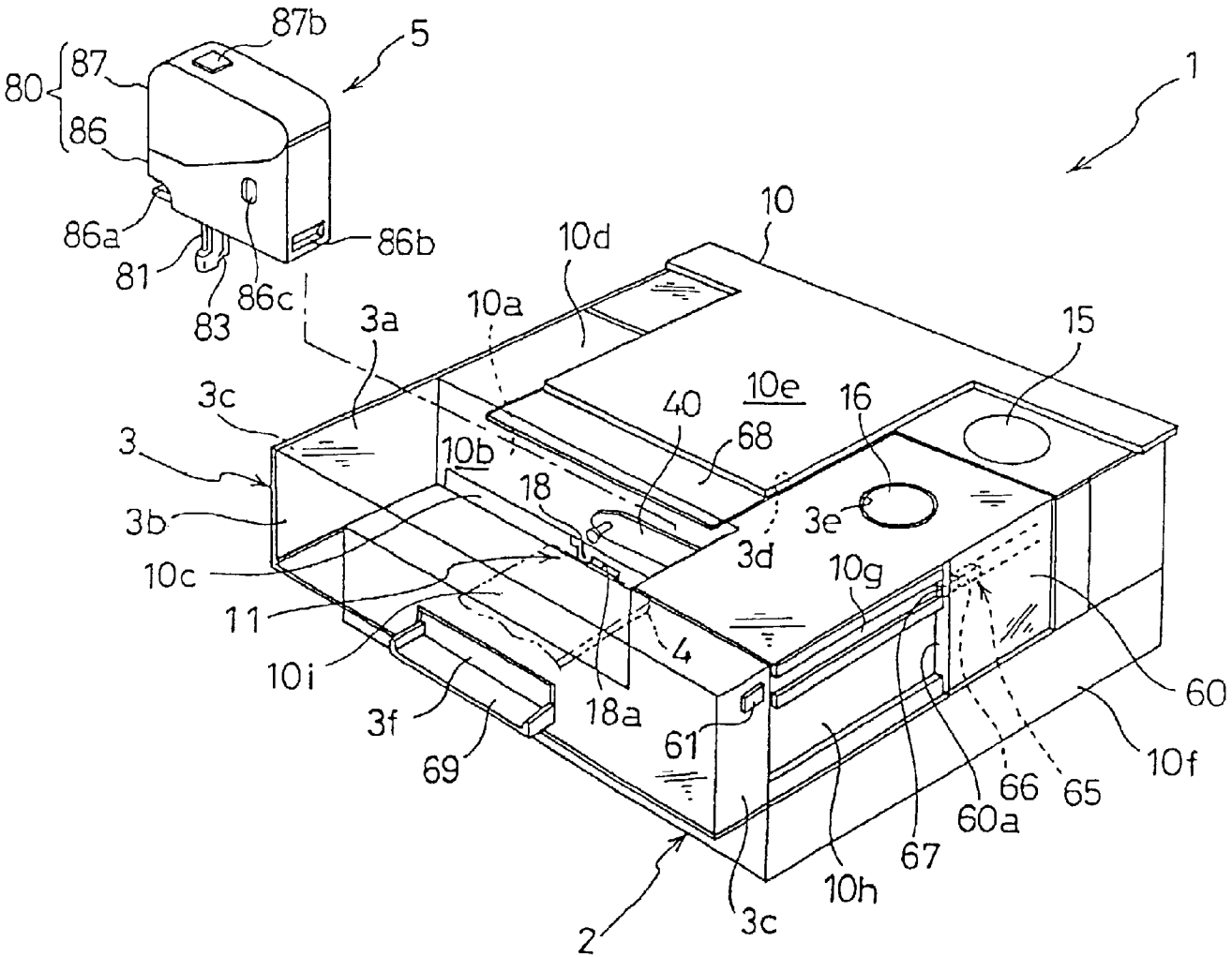
FIG. 3 is a perspective view of the sewing apparatus when the safety cover is in a sewing position.
Figure 4:
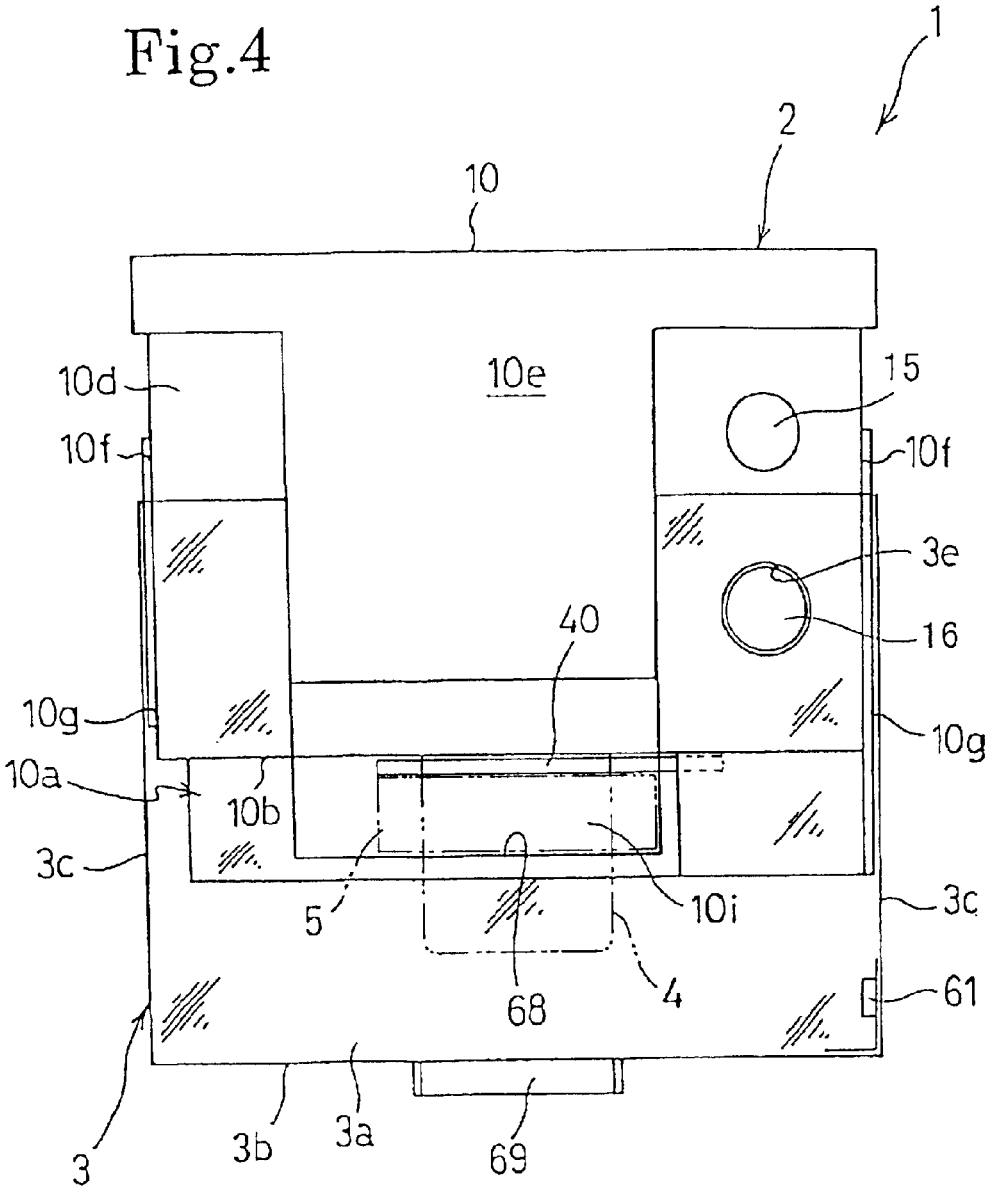
FIG. 4 is a plan view of the sewing apparatus when the safety cover is in the sewing position.
Figure 5:
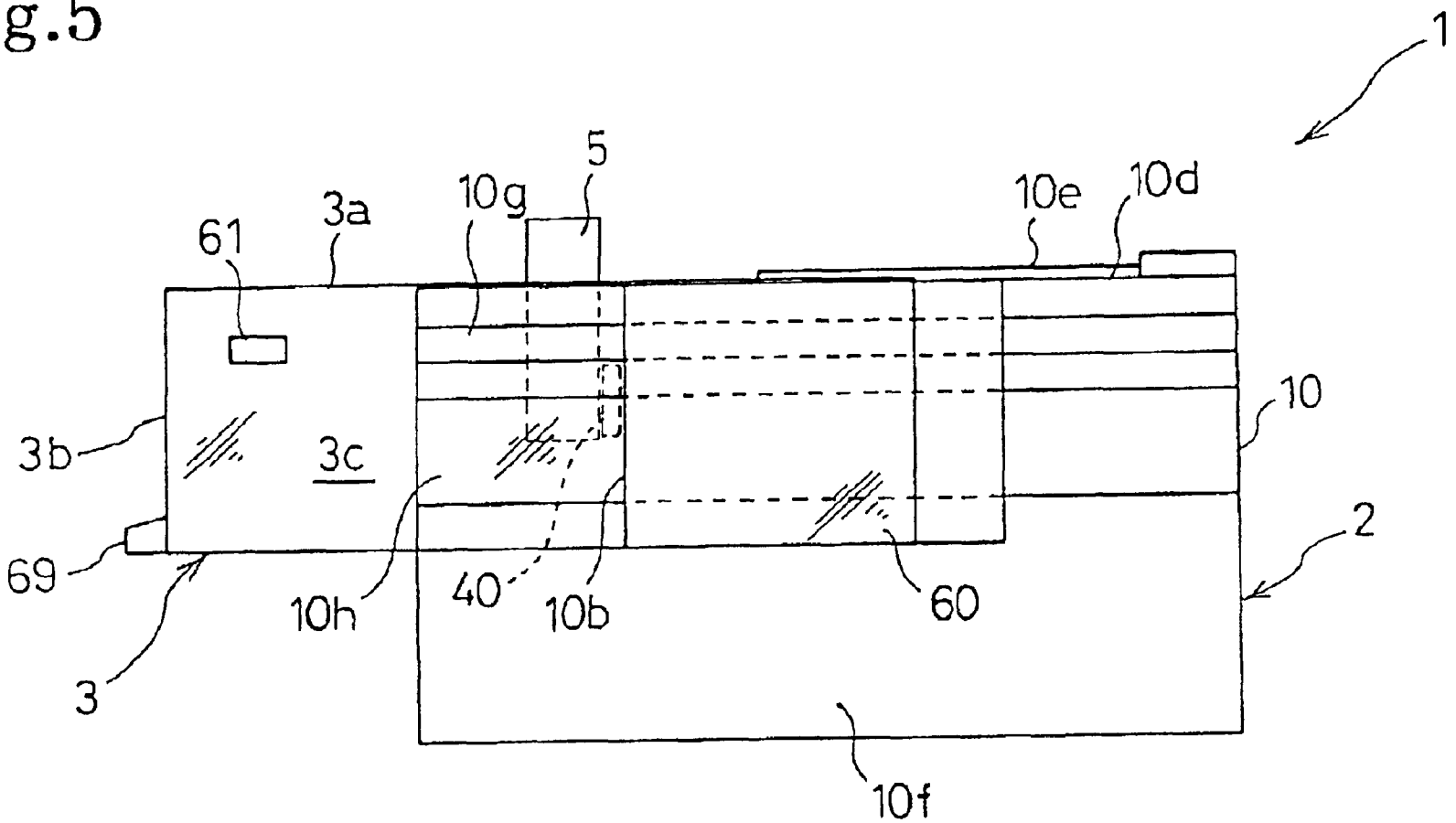
FIG. 5 is a right side view of the sewing apparatus when the safety cover is in the sewing position.

As shown in FIGS. 1 to 3, the sewing apparatus 1 includes a sewing apparatus body 2, a safety cover 3 slidably attached to the sewing apparatus body 2 in a back and forth direction, an embroidery frame 4, and a sewing cartridge 5. The embroidery frame 4 and the sewing cartridge 5 are detachably attached to the sewing apparatus body 2. A work cloth 70 to be sewn is held in the embroidery frame 4, and a hollow needle 81 capable of penetrating into the work cloth 70 is provided in the sewing cartridge 5.

As shown in FIGS. 2 to 8, the sewing apparatus body 2 includes a casing 10, an embroidery frame driving mechanism 11 that moves the embroidery frame 4 having the work cloth 70 in a horizontal plane with respect to the hollow needle 81 while the embroidery frame 4 is held by a carriage 18, a cartridge driving mechanism 12 that swings the sewing cartridge 5, attached to an oscillating arm 40, up and down, and an operational controller 13 (see FIG. 38) that controls the embroidery frame driving mechanism 11 and the cartridge driving mechanism 12.

The casing 10 is a relatively small rectangular solid, for example, 130 mm long, 165 mm wide and 70 mm high. The casing 10 contains main parts of the embroidery frame driving mechanism 11 and the cartridge driving mechanism 12, and the operational controller 13. The casing 10 is cut away approximately two-thirds of the way from a left side (as shown in FIGS. 1 and 2) of the casing 10 in the length, approximately one-fourth of the way from a front side, and approximately half of the height from the top. Thus, a cutaway space 10*a* is defined in the casing 10.

A slit 10*c*, extending in a right and left direction, is formed in a lower end portion of a front wall 10*b* of the casing 10 within the cutaway space 10*a*. The slit 10*c* is provided to attach the embroidery frame 4 to the carriage 18 and to move the embroidery frame 4 in a horizontal plane. A slit extending in a vertical direction (not shown) is formed in the side wall of the casing 10 within the cutaway space 10*a*. The oscillating arm 40 of the cartridge driving mechanism 12 protrudes into the cutaway space 10*a* from the inside of the casing 10 and is vertically movable in the vertical slit.

On an upper wall 10*d* of the casing 10, a guide upper surface 10*e* is formed as a step. A middle area of the guide upper surface 10*e* protrudes toward the front of the casing 10. On the right side of the guide upper surface 10*e* is a power switch 15, electrically connected to the operational controller 13, and a start/stop switch 16 that commands the start and an end of sewing. Upper surfaces of the power switch 15 and the start/stop switch 16 are positioned at the same or a slightly lower level than the upper surface of the upper wall 10*d*.

To assist in the attachment/detachment of the sewing cartridge 5 to/from the oscillating arm 40, in front of the guide upper surface 10*e* (described later), a front end of the guide upper surface 10*e* is longer in length in the right and left direction than the sewing cartridge 5. Accordingly, the front end of the guide upper surface 10*e* extends toward and behind the sewing cartridge 5 that is attached to the oscillating arm 40.

Guide grooves 10*g*, 10*h* are formed in the front to rear direction in right and left side walls 10*f* of the casing 10. The guide groove 10*g* is narrower than the guide groove 10*h*. An engaging block piece 67 is fixed to each guide groove 10*g* in a substantially mid-position, between the front and backsides, of the casing 10 and protrudes outwardly. Because the cutaway space 10*a* exists in the casing 10, the length of the guide grooves 10*g*, 10*h* in the left wall 10*f* is shorter than that of the guide grooves 10*g*, 10*h* in the right wall 10*f*.

Figure 6:
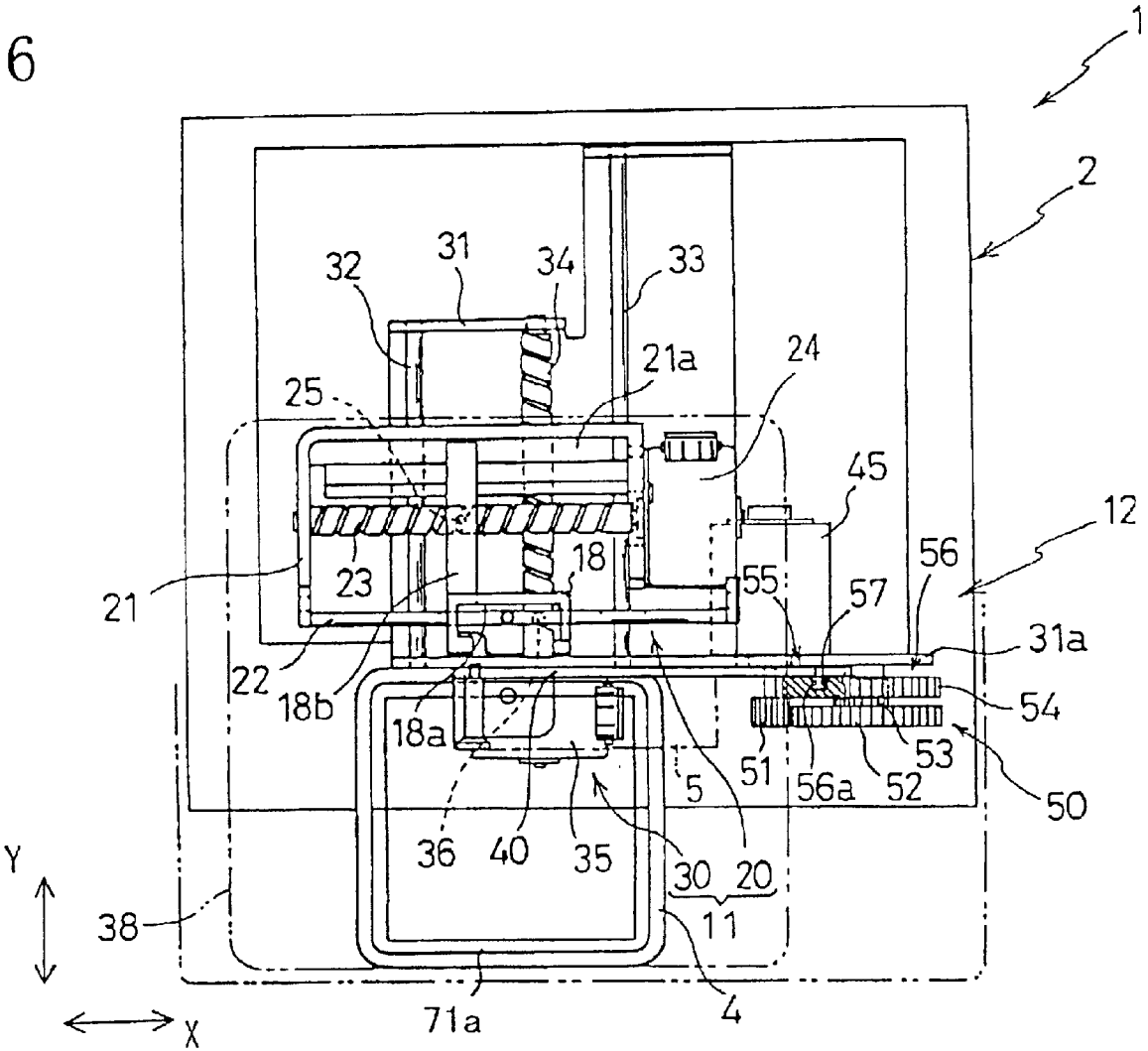
FIG. 6 is a transverse sectional view of the sewing apparatus.

As shown in FIG. 6, the embroidery frame driving mechanism 11 includes the carriage 18 to which the embroidery frame 4 is detachably attached, an X-axis direction driving mechanism 20 that drives the carriage 18 in an X direction (the left-right direction) within a horizontal plane, and a Y-axis direction driving mechanism 30 that drives the carriage 18 in a Y direction (the front and rear direction) perpendicular to the X direction, within the horizontal plane.

The carriage 18 has an engagement portion 18*a* that can engage/disengage an installation portion 4*a* of the embroidery frame 4 thereto/therefrom and a guide plate 18*b* that extends rearward from the underside of the engagement portion 18*a*. When the embroidery frame 4 is attached to or detached from the carriage 18, the carriage 18 is positioned under the oscillating arm 40. A moving frame 21 of the X-axis direction driving mechanism 20 is formed with a guide portion 21*a* in the right and left direction at its rear and is provided with a guide rod 22 in the right and left direction at its front. The carriage 18 is movably supported and guided in the right and left direction by the guide portion 21*a* and the guide rod 22.

The X-axis direction driving mechanism 20 has the moving frame 21, the guide rod 22, a screw shaft 23, a pulse motor 24 (FIG. 6), and a guide pin 25. The moving frame 21 has a substantially box shape and an upper open structure. The guide rod 22 is supported by side walls of the moving frame 21 at its ends. The screw shaft 23 is disposed inside of the moving frame 21, extending in the right and left direction. A left end of the screw shaft 23 is rotatably supported by the left wall of the moving frame 21. The pulse motor 24 is fixed on the right of the right wall of the moving frame 21. An output shaft of the pulse motor 24 is directly connected to a right end of the screw shaft 23.

The guide plate 18*b* of the carriage 18 is disposed above the screw shaft 23. The guide pin 25 is fixed to the guide plate 18*b* so as to protrude downward. The guide pin 25 slidably engages a spiral groove formed in the screw shaft 23. As the screw shaft 23 is rotated by the pulse motor 24, the guide pin 25 is guided along the spiral groove, so that the guide pin 25 moves from side to side. As a result, the carriage 18 is moved in the X direction.

The Y-axis direction driving mechanism 30 has a support frame 31, two guide rods 32, 33, a screw shaft 34, a pulse motor 35, and a guide pin 36. The support frame 31 has a substantially concave shape when viewed from the side. The guide rods 32, 33, extend in the front to back direction and are supported by the front and the rear walls at their ends. The support frame 31 of the Y-axis driving mechanism 30 is movably supported and guided in the back and forth direction by the guide rods 32, 33.

The screw shaft 34 extends in the front to back direction. The screw shaft 34 is rotatably supported by the rear wall of the support frame 31 at its rear end. The pulse motor 35 is fixed at the front of the front wall of the support frame 31. An output shaft of the pulse motor 35 is directly connected to the front end of the screw shaft 34. The guide pin 36 is fixed to the moving frame 21 so as to protrude downward. The guide pin 36 slidably engages a spiral groove formed in the screw shaft 34. As the screw shaft 34 is rotated by the pulse motor 35, the guide pin 36 is guided along the spiral groove, so that the guide pin 36 moves back and forth. As a result, the carriage 18 is moved in the Y direction together with the moving frame 21. The Y-axis direction driving mechanism 30 is disposed under the X-axis direction driving mechanism 20.

An embroidery frame moving area 38, shown in FIG. 6, is an area in which the embroidery frame 4, attached to the carriage 18, can be moved by the embroidery frame driving mechanism 11. The hollow needle 81 in the sewing cartridge 5 attached to the sewing apparatus body 2 is positioned substantially at a center of the embroidery frame moving area 38. The sewing cartridge 5 is attached to the forward part of the sewing apparatus body 2, so that the embroidery frame moving area 38 extends forward from the casing 10. As described above, the Y-axis direction driving mechanism 30 is disposed under the X-axis direction driving mechanism 20 and each of the driving mechanisms 20, 30 is positioned under the embroidery frame moving area 38 of the carriage 18. Accordingly, the sewing apparatus body 2 can be downsized.

As shown in FIGS. 3, 4, 6, and 14, a needle plate 121 is provided at a bottom wall 10*i* of the casing 10 and is positioned under the embroidery frame moving area 38 of the embroidery frame 4. The needle plate 121 has a passing portion 121*a* through which the hollow needle 81 passes. A substantially cylindrical protruding portion 122 that protrudes upward is provided around the passing portion 121*a* of the needle plate 121. When the hollow needle 81 penetrates the work cloth 70, the work cloth 70 is held from underneath by the protruding portion 122 and from above by the needle cover 83 of the sewing cartridge 5.

As shown in FIGS. 6 to 9, the cartridge driving mechanism 12 has the oscillating arm 40 that the sewing cartridge 5 is attached to or detached from, a machine motor 45, that is an AC motor, as drive source to move the oscillating arm 40 up and down, a gear mechanism 50 that reduces the rotation speed of the machine motor 45, and a cam mechanism 55 that converts a rotary motion, reduced in its rotation speed by the gear mechanism 50, into up-and-down movements of the oscillating arm 40.

As shown in FIGS. 7, 8, and 22 to 24, the oscillating arm 40 is formed with an arm portion 40*a*, extending in the right and left direction, and a lever portion 40*b*, extending in the up and down direction, which are integral to form a single structure. The oscillating arm 40 is disposed at substantially the right half part of the forward part of the casing 10. The lever portion 40*b* is pivotally supported at its middle portion by a pivot shaft 41*b* which is supported by the sewing apparatus body 2 via a bracket 41*a*. A largest portion of the arm portion 40*a* protrudes toward the cutaway space 10*a*. The remaining portion, including the lever portion 40*b*, is accommodated in the casing 10.

An engaging pin 42, extending from front to rear of the casing 10, is fixed at a left end portion of the arm portion 40*a*. A lock release pin 43, also extending from front to rear, is fixed to the right of the engaging pin 42 so as to protrude toward the front of the casing 10. An engaging member 44*a* is rotatably supported by the oscillating arm 40. The oscillating arm 40 is provided with a torsion spring (not shown) that rotatably urges the engaging member 44*a* in a clockwise direction. An engagement plate 19, that is integrally formed with a machine frame of the sewing apparatus body 2, is provided behind the oscillating arm 40. The engagement plate 19 extends from the right part of the machine frame of the sewing apparatus body 2 and toward the left. In front of the engagement plate 19, an operating member 44*b*, that is operated to rotate the engaging member 44*a* in a counterclockwise direction, is operably rotatably supported.

The engaging pin 42, the lock release pin 43, the engaging member 44*a*, and the operating member 44*b* are provided in order to attach/detach the sewing cartridge 5 to/from the oscillating arm 40.

The machine motor 45 is fixed to the back of the right lower portion of the front wall 31 a of the support frame 31 so that a rotational shaft of the machine motor 45 extends toward the front of the casing 10.

A gear mechanism 50 includes gears 51, 52, 53 and 54 disposed in front of the front wall 31 a of the support frame 31 as shown in FIGS. 6, 7, 8 and 9. The drive gear 51 is fixed to the output shaft of the machine motor 45. The intermediate gears 52 and 53, which are internally connected on the same shaft, and the large-diameter gear 54 are rotatably supported at the front wall 31*a*. The drive gear 51 engages the intermediate gear 52. The intermediate gear 53 engages the large-diameter gear 54. Thus, rotation speed of the large-diameter gear 54 is reduced with respect to the rotation speed of the machine motor 45 (the drive gear 51).

Figure 9:
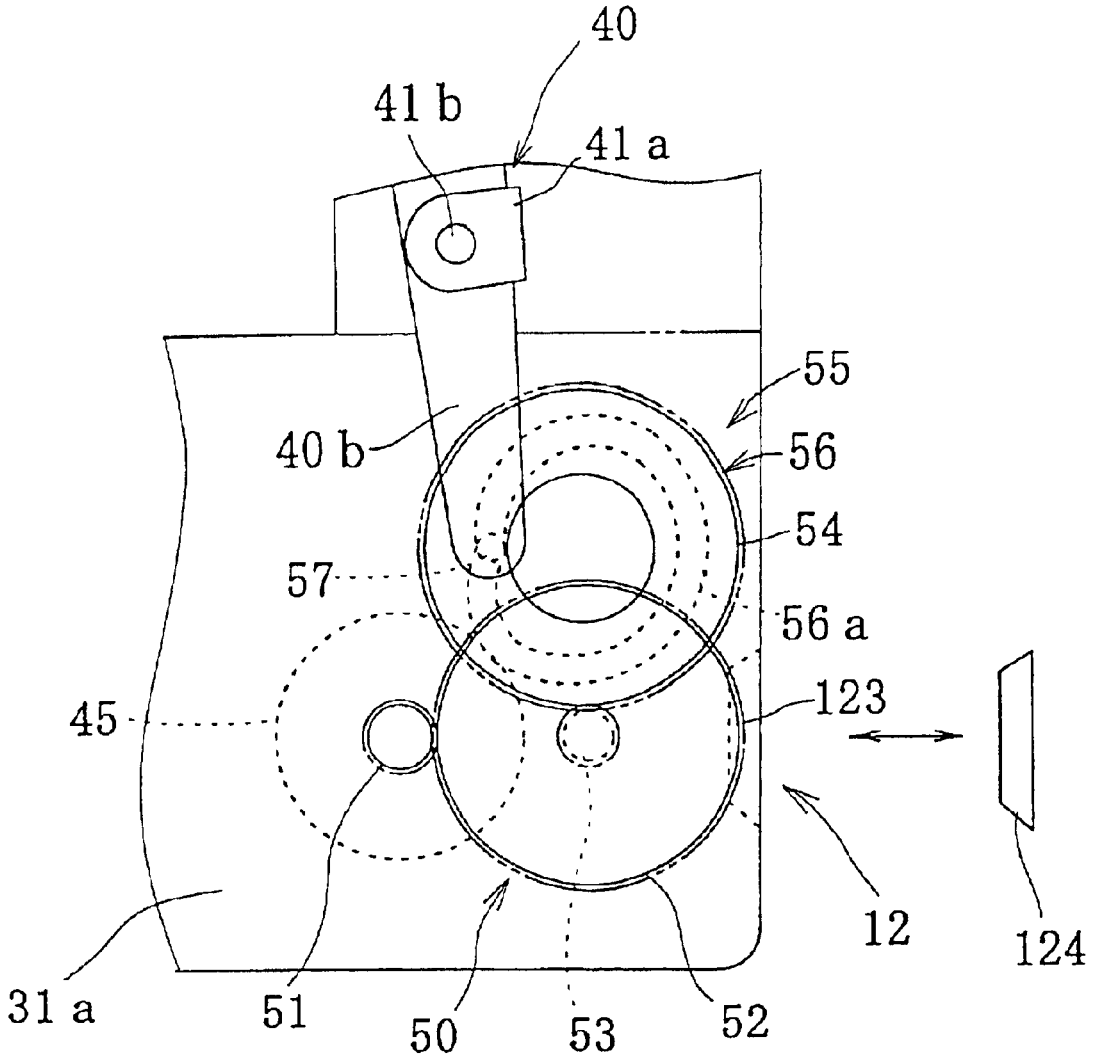
FIG. 9 is a partially enlarged view of a gear mechanism and a cam mechanism.

As shown in FIG. 9, an inspection window 123 is formed in the sewing apparatus body 2 so that the right side of the intermediate gear 52 can be seen from the inspection window 123. A cover 124 that covers the inspection window 123 is detachably provided in the machine frame of the sewing apparatus body 2. The cover 124 is detached in a state where the machine motor 45 is stopped, so that the intermediate gear 52 can be manually operated through the inspection window 123. The inspection window 123 may be formed in the sewing apparatus body 2 so that the right side of the large-diameter gear 54 can be seen and manually operated from the inspection window.

As shown in FIGS. 6 to 10, the cam mechanism 55 has a cam 56 that is rotatably supported by the front wall 31*a* and a cam follower 57 that is fixedly attached to the right end of the oscillating arm 40 to protrude toward the front. The outer region of the cam 56 is formed with gear teeth of the large-diameter gear 54. A cam groove 56*a* is formed on the back of the cam 56. The cam follower 57 is slidably engaged with the cam groove 56*a*.

Figure 10:
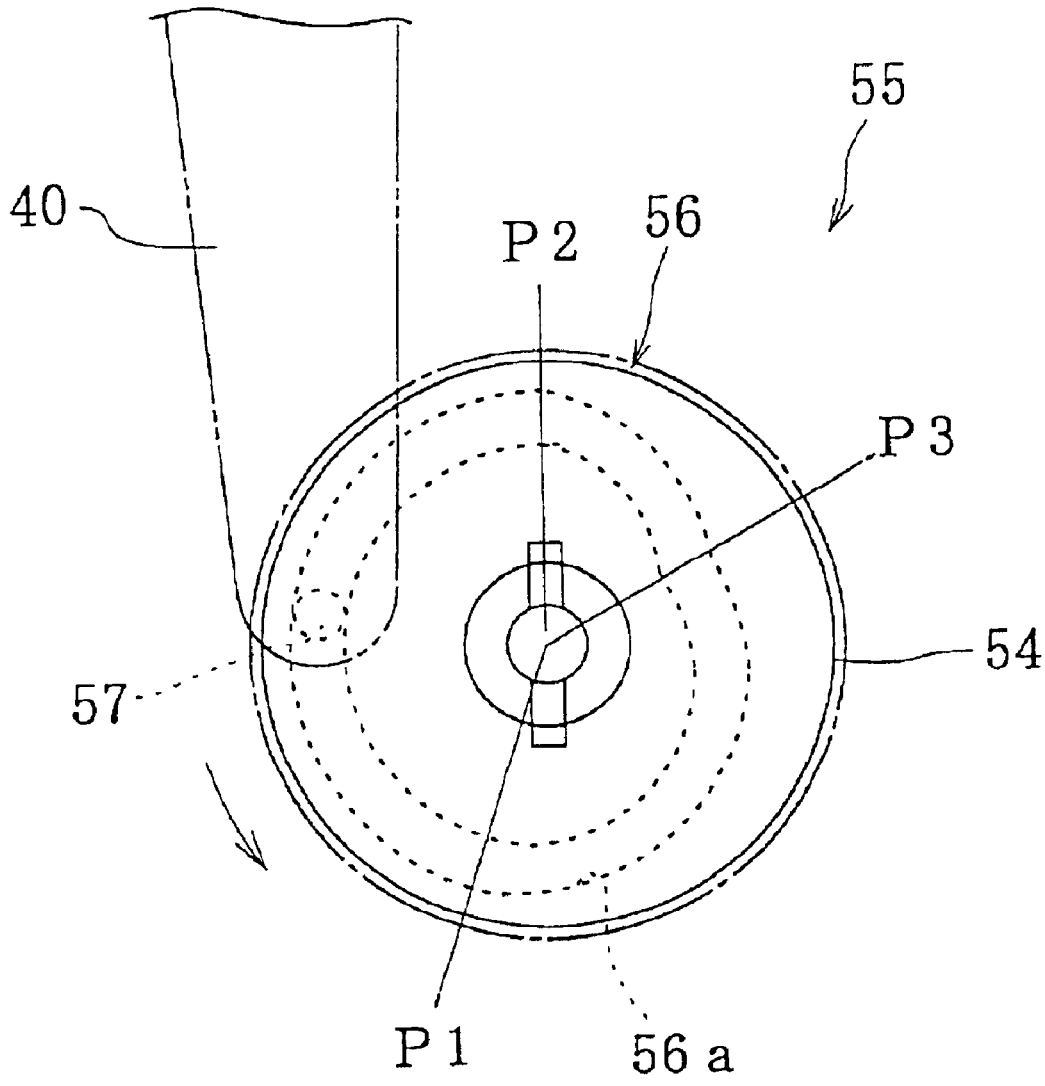
FIG. 10 is a front view of a cam.

As shown in FIG. 10, the cam groove 56*a* is formed into a loop wherein a distance between the cam groove 56*a* and a center of rotation of the cam 56 is changed. When the cam 56 is turned, the arm portion 40*a* travels vertically between an upper limit position, shown in FIG. 7, and a lower limit position, shown in FIG. 8. Additionally, a speed with which the hollow needle 81 releases from the work cloth 70 is slower than a speed with which the hollow needle 81 penetrates the work cloth 70.

Figure 7:
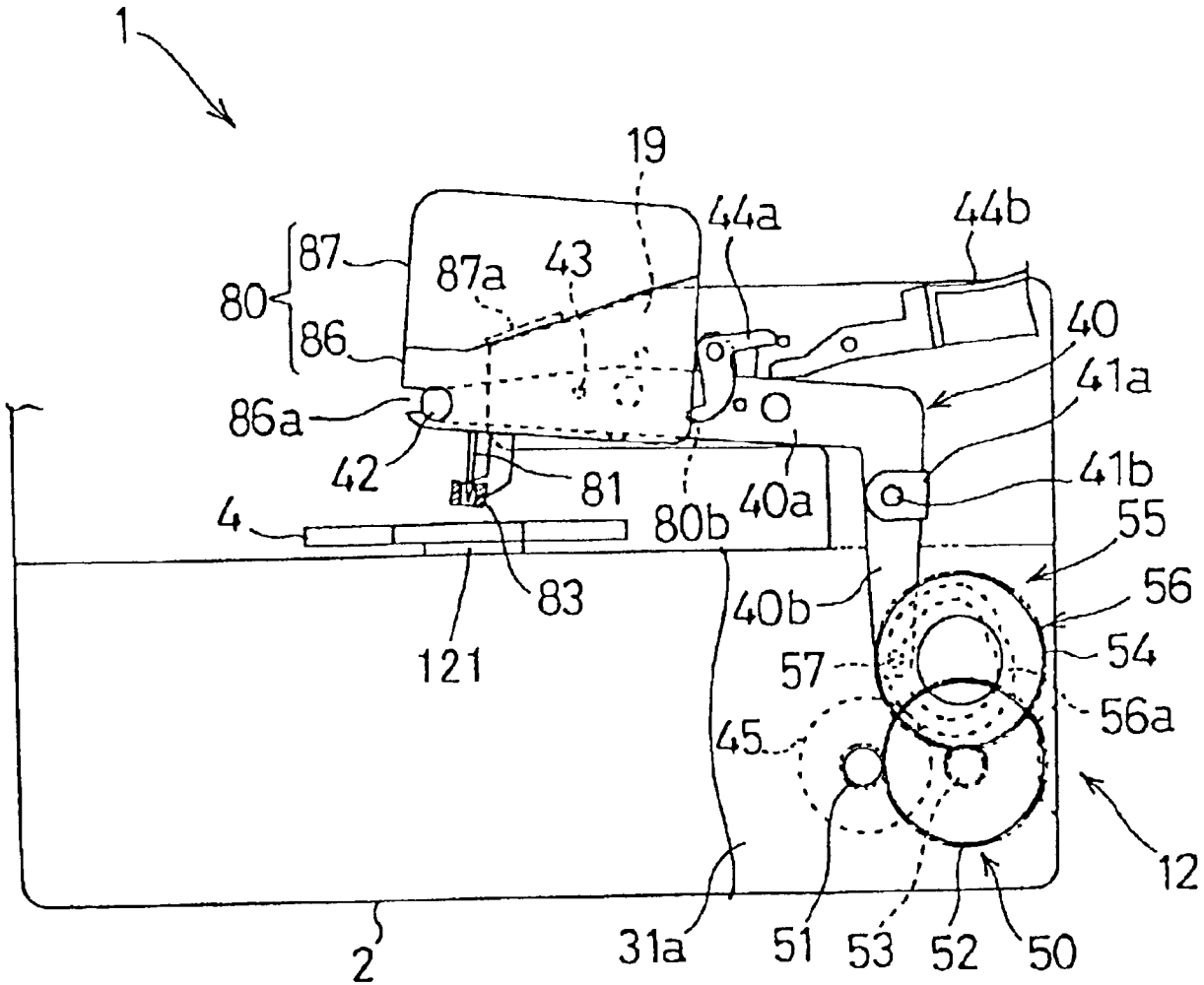
FIG. 7 is a partial perspective view of the sewing apparatus when a hollow needle is in an upper limit position as seen from the front.
Figure 8:
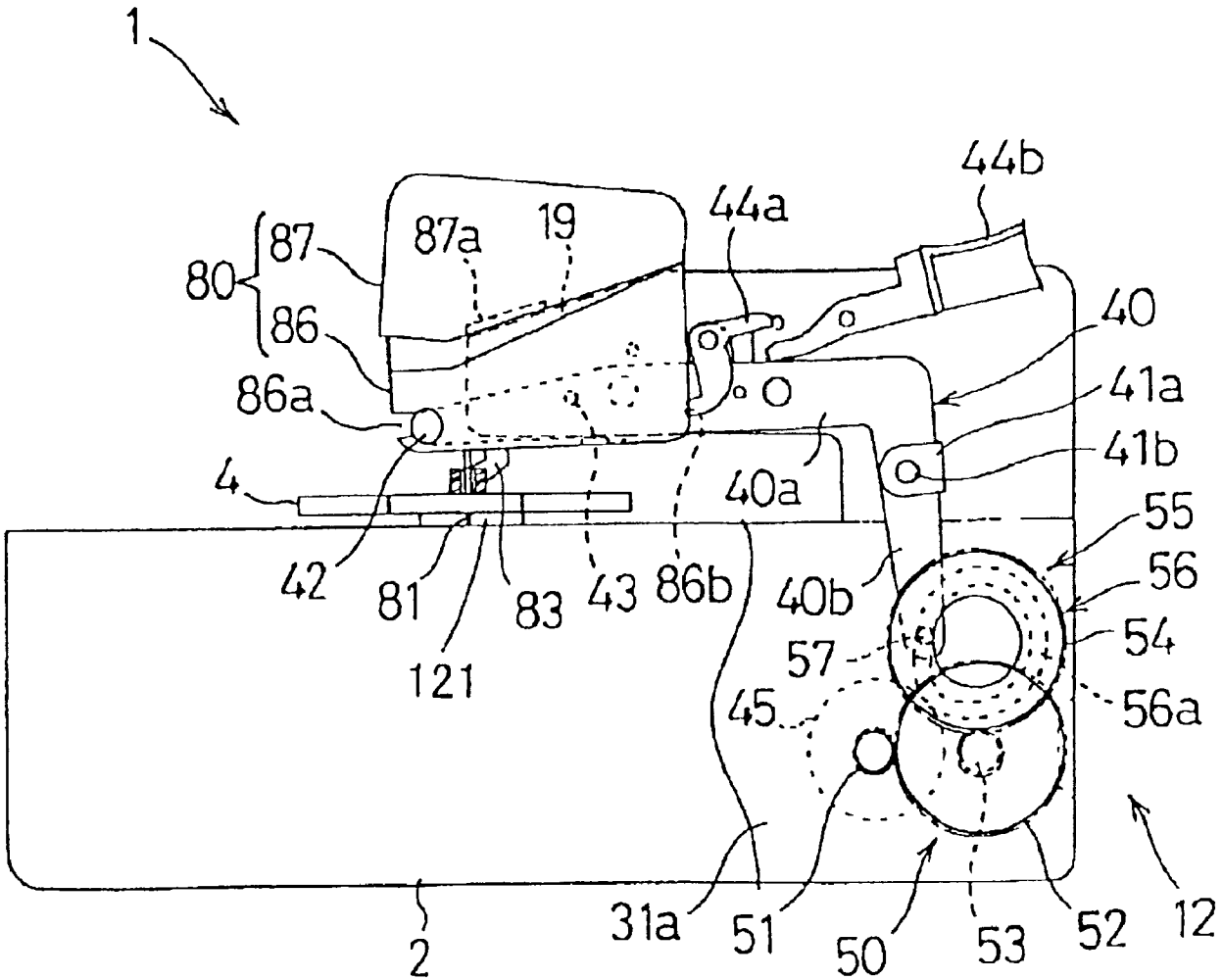
FIG. 8 is a partial perspective view of the sewing apparatus when the hollow needle is in a lower limit position as seen from the front.

As shown in FIGS. 7 to 10, in an angle of approximately 160 degrees from point P1 to point P2 in the cam groove 56*a*, the cam follower 57 is positioned in engagement with the cam groove 56*a* and the distance between the cam groove 56*a* and the center of rotation of the cam 56 is fixed and maximized, and the arm portion 40*a* of the oscillating arm 40 is held at the upper limit position (FIG. 7). In an angle of approximately 50 degrees from point P2 to point P3 in the cam groove 56*a*, the distance is changed from the maximum to the minimum and the arm portion 40*a* rapidly descends from the upper limit position to the lowest limit position (FIG. 8).

In an angle of approximately 150 degrees from point P3 to point P1 in the cam groove 56*a*, the distance is changed from the minimum to the maximum and the arm portion 40*a* gradually ascends from the lower limit position to the upper limit position. With the structure of the cam mechanism 55, the speed with which the hollow needle 81 releases from the work cloth 70 by moving the oscillating arm 40 upward becomes slower than the speed with which the hollow needle 81 penetrates the work cloth 70 by moving the oscillating arm 40 downward.

As shown in FIGS. 2 to 5, the safety cover 3 has the functions of protecting the embroidery frame 4, the sewing cartridge 5, and the oscillating arm 40 which are movable, covering the hollow needle 81 and the embroidery frame moving area 38 (FIG. 6) is so that a user, such as a child, will not be hurt, and of preventing an occurrence of undesired operation of the start/stop switch 16. The safety cover 3 can cover the entire embroidery frame moving area 38. The safety cover 3 can be moved between a sewing position (see FIG. 3), where the safety cover 3 covers the embroidery frame moving area 38 at the time when sewing is executed, and a storage position (see FIG. 2), where the safety cover 3 is in a position for storage or packing.

The safety cover 3 is formed of a transparent or a translucent material made of a synthetic resin. The safety cover 3 has an upper wall 3*a*, a front wall 3*b*, and right and left side walls 3*c*. The safety cover 3 does not have a lower wall or a rear wall. The upper wall 3*a* of the safety cover 3 is formed with a recessed area 3*d* which is recessed at the rear, generally center portion. The recessed area 3*d* engages the guide upper surface 10*e* of the casing 10 so that the safety cover 3 can slide back and forth. The lower surface of the upper wall 3*a* of the safety cover 3 can contact the upper surface of the upper wall 10*d* of the casing 10, except for the guide upper surface 10*e*.

A vertical plate 60 is fixed inside of the rear part of each side wall 3*c* of the safety cover 3. An engagement piece 66 is fixed inside of the upper rear portion of each vertical plate 60. An engagement portion 60*a* is integrally formed with each vertical plate 60 under the engagement piece 66. Each engagement piece 66 slidably engages a guide groove 10*g* formed in each side wall 10*f* of the casing 10. The guide groove 10*h* is also formed in each side wall 10*f*. Each engagement portion 60*a* slidably engages a guide groove 10*h*. Inside of the forward part of the right side wall 3*c* of the safety cover 3, is fixed an engagement piece 61, which can slidably engage the guide groove 10*g*.

A stopper mechanism 65 is provided to position the safety cover 3 in the sewing position and to regulate the safety cover 3 so as not to be removed from the sewing apparatus body 2. The stopper mechanism 65 has the engagement pieces 66, which are fixed to each side wall 3*c* of the safety cover 3, and the engagement block pieces 67, which are fixed to each guide groove 10*g* of each side wall 10*f* of the casing 10 and protrude outwardly. When the guide pieces 66 engage the engagement block pieces 67, the safety cover 3 is in the sewing position. As a result, the safety cover 3 cannot move forward from the sewing position.

In a state where the safety cover 3 is switched to the storage position shown in FIG. 2, the recessed area 3*d* of the safety cover 3 completely engages the guide upper surface 10*e* of the casing 10. The rear end of the upper wall 3*a* of the safety cover 3 contacts the stepped portion of the guide upper surface 10*e*. The front wall 3*b* of the safety cover 3 is brought closer to the front surface of the casing 10. When the safety cover 3 is in the storage position, the embroidery frame moving area 38 is not entirely covered by the safety cover 3. As the safety cover 3 is switched to the sewing position shown in FIG. 3, by sliding the safety cover 3 forward from the storage position shown in FIG. 2, the entire embroidery frame moving area 38 is covered with the safety cover 3.

In a state where the safety cover 3 is switched to the sewing position shown in FIG. 3, a cartridge insertion slot 68 is defined by the front end of the guide upper surface 10*e* of the casing 10 and the recessed area 3*d* of the safety cover 3. The width of the cartridge insertion slot 68 is substantially equal to the width of the sewing cartridge 5 (see FIG. 4). The length of the cartridge insertion slot 68 is longer than that of the sewing cartridge 5. The sewing cartridge 5 can be attached to the oscillating arm 40 by inserting the sewing cartridge 5 from the cartridge insertion slot 68. When the sewing cartridge 5 is inserted into the safety cover 3 from the cartridge insertion slot 68, the sewing cartridge 5 is guided by the cartridge insertion portion 68 and attached to the oscillating arm 40. In a state where the sewing cartridge 5 is attached to the sewing apparatus body 2, the safety cover 3 is regulated in its position to the sewing position by the sewing cartridge 5.

A switch operating hole 3*e* is formed on the right in the upper wall 3*a* of the safety cover 3. When the safety cover 3 is in the storage position shown in FIG. 2, the switch operating hole 3*e* is opposed to the power switch 15. Therefore, the power switch 15 can be operated via the switch operating hole 3*e*. In this state, the start/stop switch 16 is covered with the safety cover 3, so that the start/stop switch 16 cannot be operated.

The power switch 15 is disposed to the rear of the start/stop switch 16. The distance between centers of the power switch 15 and the start/stop switch 16 is approximately the same as the amount of back-and-forth movement of the safety cover 3. Accordingly, in the state where the safety cover 3 is in the sewing position shown in FIG. 3, the switch operating hole 3*e* is opposed to the start/stop switch 16, so that the start/stop switch 16 can be operated via the switch operating hole 3*e*. That is, the prohibition provided by the safety cover 3 is withdrawn.

When the safety cover 3 is in the sewing position, the power switch 15 is exposed at the rear portion of the safety cover 3, thereby enabling the operation of the power switch 15. The power switch 15 is available when the safety cover 3 is in both the storage position and the sewing position. The power switch 15, the start/stop switch 16, and the switch operation hole 3*e* are formed in substantially the same way as described above.

An embroidery frame insertion slot 3*f* is formed at a substantially middle portion in the right and left direction (perpendicular to the sliding direction of the safety cover 3) of the lower portion of the front wall 3*b* of the safety cover 3. The embroidery frame 4 can be inserted into the safety cover 3 via the embroidery frame insertion slot 3*f*. A guide member 69 protruding forward is fixed to the front wall 3*b*. The guide member 69 guides the embroidery frame 4 in the back and forth direction when the embroidery frame 4 is attached to the carriage 18 by inserting the embroidery frame 4 into the safety cover 3 from the embroidery frame insertion slot 3*f*. The embroidery frame insertion slot 3*f* is in a position displaced to the right slightly from a middle position within the moving range of the carriage 18 in the right and left direction (a middle position of the embroidery frame moving area 38 in the right and left direction).

When the carriage 18 is positioned substantially under the oscillating arm 40, the carriage 18 is in a foremost position. Accordingly, the embroidery frame 4, which is guided by the guide member 69 and is inserted into the inside of the safety cover 3 via the embroidery frame insertion slot 3*f*, can be attached to the carriage 18. The guide member 69 can also be used as a means for moving the safety cover 3.

The embroidery frame 4 that holds the work cloth 70 will be described with reference to FIGS. 2, 6, and 11 to 13. The embroidery frame 4 has first and second clamping members 71, 72, a clamping member holding portion 125, and operating members 126 and 127. The first and second claming members 71 and 72 are structural components to sandwich the work cloth 70 between the first and second clamping members 71 and 72. The first and second clamping members 71 and 72 are rectangular and pivotally connected to each other at their front ends via a pivot 128. The clamping member holding portion 125 includes a pair of engaging portions 125*a* and a pair of engaging holes 125*b* and has a function of holding the first and second holders 71 and 72 in a clamped state.

The engaging portions 125*a* are formed at the right and left corners of a rear end of the first clamping member 71 and protrude upward. The engaging holes 125*b* are formed at the right and left corners of a rear end of the second clamping member 72 so as to be engaged with the engaging portions 125*a*. Each of the engaging portions 125*a* is divided into three portions in a direction of circumference and urged slightly outwardly. Therefore, the engaging portions 125*a* are engaged with the engaging holes 125*b* to maintain the first and second clamping members 71 and 72 in the clamped state.

The operating members 126 and 127 are used to release the clamped state of the first and second clamping members 71 and 72 and are provided respectively on the first and second clamping members 71 and 72. The operating member 126 is integrally formed at the rear end of the first clamping member 71. The installation portion 4*a* where the embroidery frame 4 is attached to the sewing apparatus body 2 is formed on a part of the operating member 126. The operating member 127 is integrally formed at the rear end of the second clamping member 72. When the operating members 126 and 127 are separated in a direction opposite to each other, the clamped state at the clamping member holding portion 125 is set free.

Figure 11:
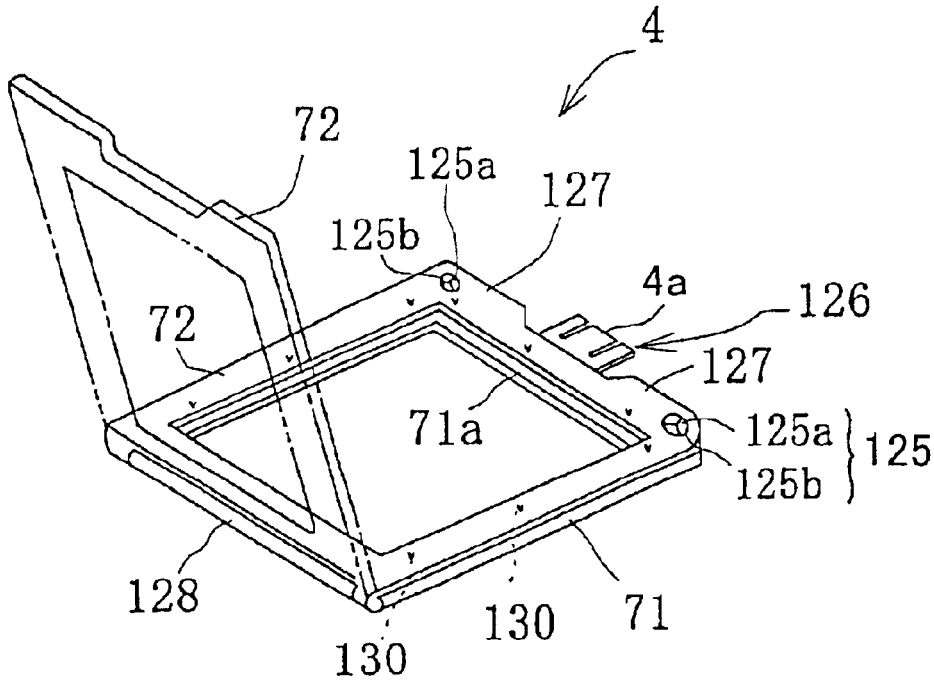
FIG. 11 is a perspective view of an embroidery frame.
Figure 12:
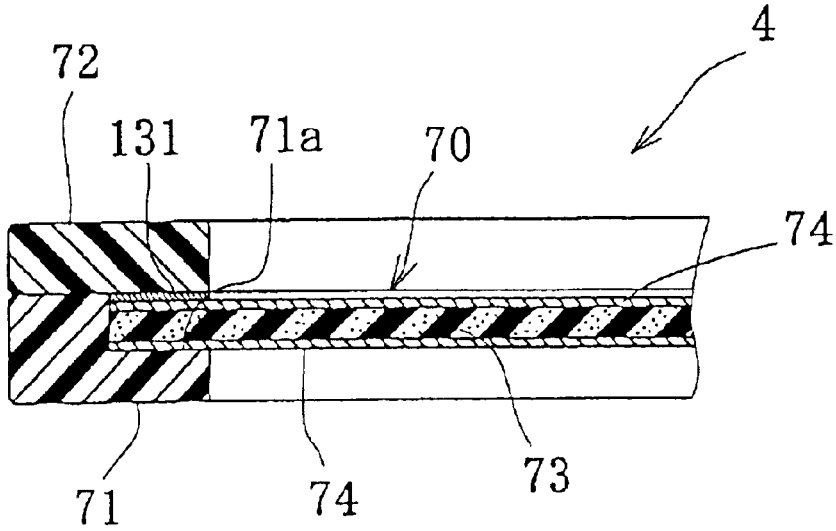
FIG. 12 is a partially vertical sectional view of the embroidery frame.

As shown in FIGS. 11 and 12, a stepped portion 71 a is rectangularly formed at an internal edge of the clamping member 71. The stepped portion 71 a is stepped down with respect to an upper surface of the clamping member 71. An outer region of a work cloth 70 is fit to the stepped portion 71*a*. The work cloth 70 is held by the second clamping member 72 and attached to the substantially entire embroidery frame 4 under a tension. The work cloth 70 can be releasably attached to the embroidery frame 4 via a double-sided adhesive tape or an adhesive in some cases. A plurality of minute projections 130 are formed at the internal edge on an undersurface of the second clamping member 72. The minute projections 130 serve to stably hold the work cloth 70.

Figure 13:
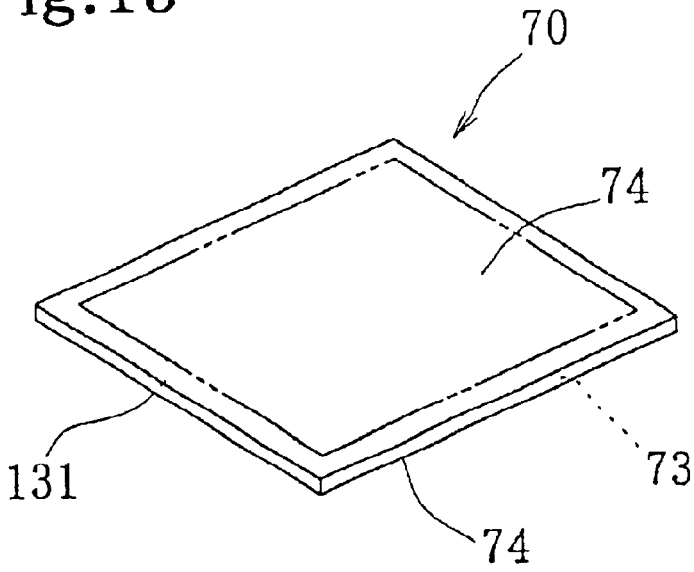
FIG. 13 is a perspective view of a work cloth.

As shown in FIGS. 12 and 13, for example, the work cloth 70 has elasticity and is a multi-layer structure formed in which an elastic film member 73, made of urethane, is sandwiched by a pair of woven work cloths 74 by lamination. When sewing is performed on the work cloth 70 in the sewing apparatus 1, the elastic film member 73 produces a thread holding force that causes a thread 99 to remain in the work cloth 70. A frame 131 of cardboard is firmly fixed around the periphery of the upper surface of the work cloth 70 in order to prevent the work cloth 70 from losing its shape during and after sewing and to facilitate succeeding operations such as cutting after sewing. A plurality of sets of the embroidery frame 4 and the work cloth 70 set in the embroidery frame 4 are prepared in advance.

As shown in FIGS. 2, 3 and 15 to 21, the sewing cartridge 5 includes a cassette body 80, the hollow needle 81 that can pass through the work cloth 70, a spool 82 around which the thread 99 to be supplied to the hollow needle 81 is wound, a needle cover 83 that covers at least a tip of the hollow needle 81, a coil compression spring 84 that urges the needle cover 83 to a cover position where the needle cover 83 covers the hollow needle 81, and a movement prohibiting mechanism 85 that prohibits the movement of the needle cover 83 positioned at the cover position. For this sewing apparatus 1, a plurality of sewing cartridges 5 that can be detachably attached to the oscillating arm 40 are prepared. Each of the sewing cartridges 5 accommodates a different color thread, so that a colorful embroidery pattern can be formed using several sewing cartridges 5.

The cassette body 80 has a rectangular shape like a horizontally oriented standing matchbox. The cassette body 80 has a housing case 86 and an openable cover 87. The housing case 86 is movable with respect to the sewing apparatus body 2 in a state where the cassette body 80 is attached to the oscillating arm 40. The openable cover 87 is substantially fixed with respect to the sewing apparatus body 2. The housing case 86 accommodates the upper portion of the hollow needle 81 and the needle cover 83, the spool 82, the coil compression spring 84, and the movement prohibiting mechanism 85.

Figure 18:
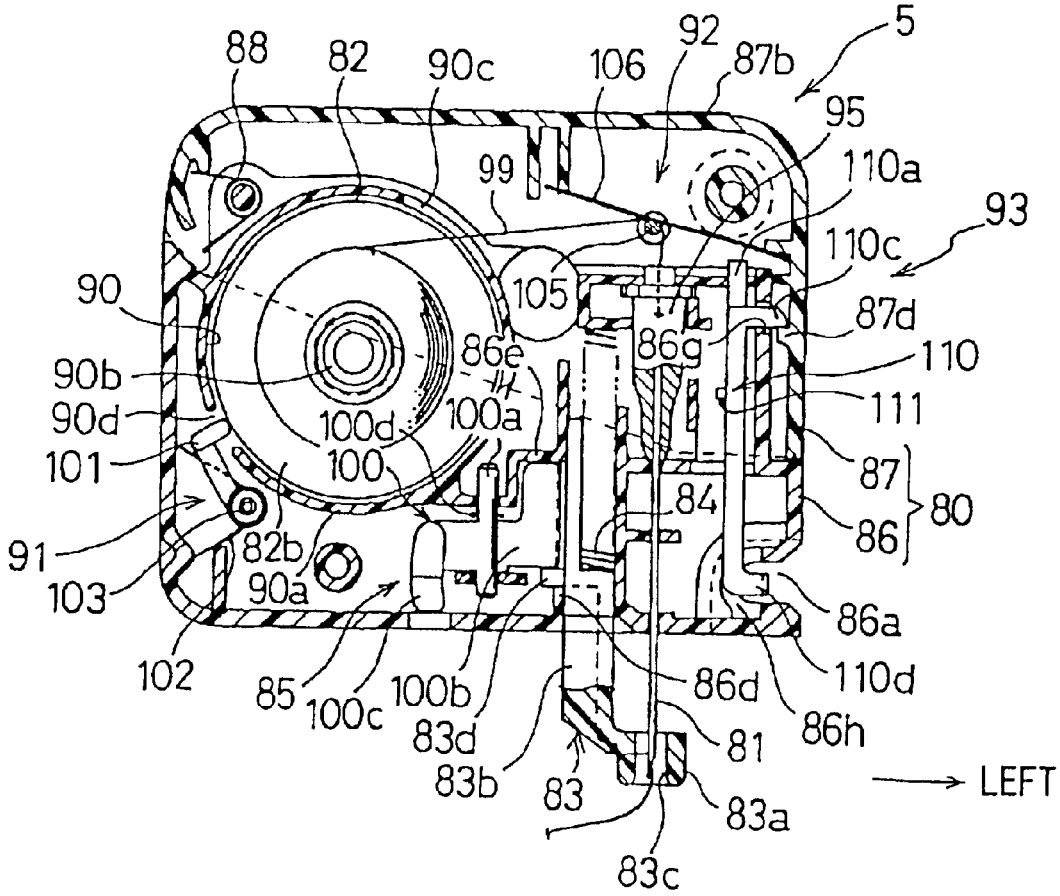
FIG. 18 is a vertical sectional view of the sewing cartridge in a closed state.
Figure 19:
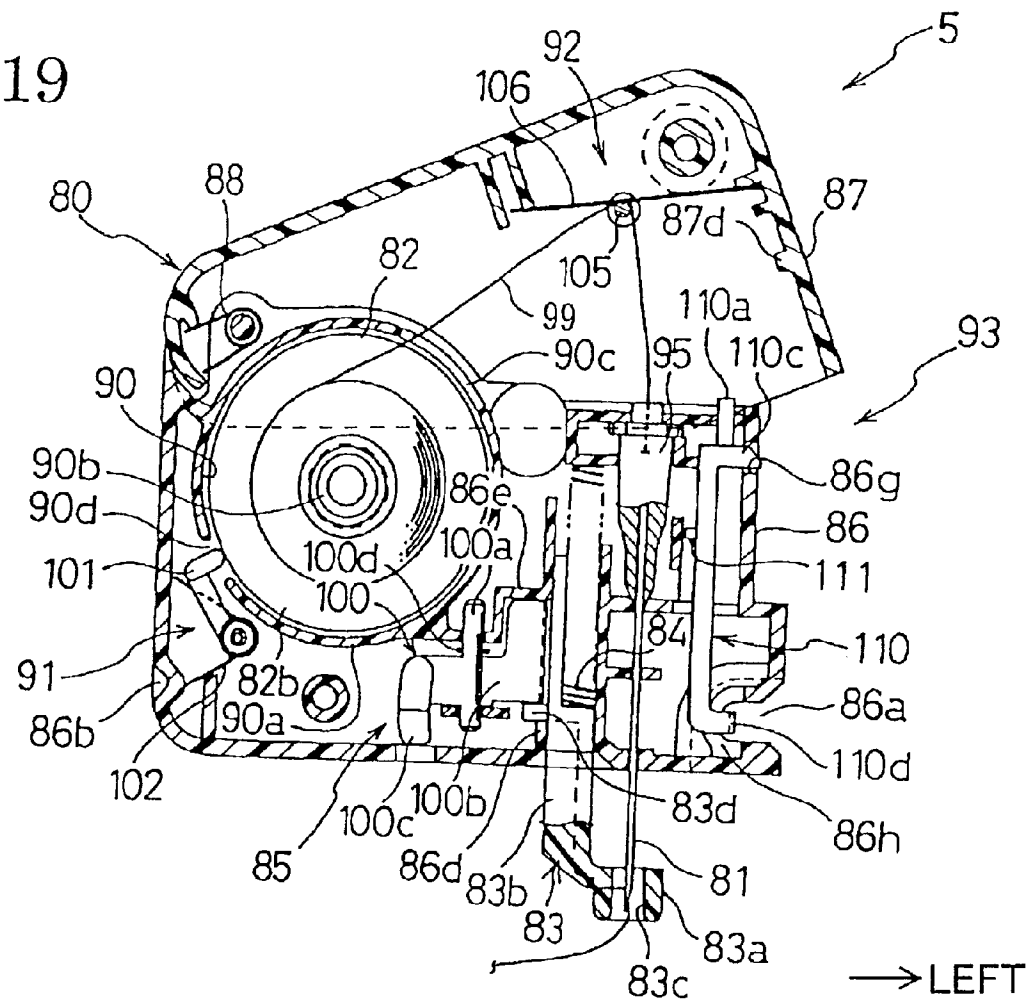
FIG. 19 is a vertical sectional view of the sewing cartridge in an open state.

As shown in FIGS. 18 and 19, the housing case 86 and the openable cover 87 are rotatably connected to each other at an upper left portion of the cassette body 80. The openable cover 87 travels between a closed position shown in FIG. 18 and an open position shown in FIG. 19 with respect to the housing case 86. That is, the openable cover 87 is maintained at a fixed position and the housing case 86 is opened and closed with respect to the openable cover 87. A torsion spring 88 is attached to a pivot shaft that pivotally supports the openable cover 87 with respect to the housing case 86. The openable cover 87 is rotatably urged to the closed position by the torsion spring 88.

The sewing cartridge 5 includes a housing area 90 where the spool 82 is housed, an excessive rotation preventive mechanism 91, a thread holding mechanism 92, and a locking mechanism 93. The excessive rotation preventive mechanism 91 prevents the spool 82 accommodated in the housing area 90 from rotating excessively in the thread supply direction so that excessive feeding of the thread 99 is prevented. The thread holding mechanism 92 holds the thread 99 extending from the housing area 90 and prevents the thread 99 from being drawn back to the housing area 90 side from the hollow needle 81 side by applying resistance to the thread 99 drawn partway from the spool 82 to the hollow needle 81. The locking mechanism 93 locks the openable cover 87 in the closed position with respect to the housing case 86.

Figure 15:
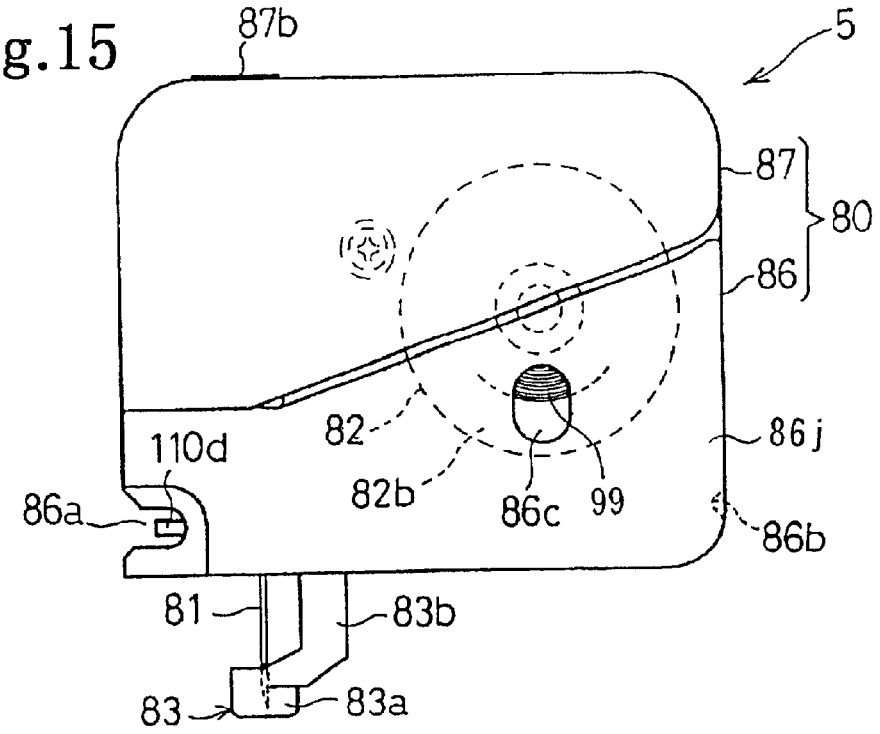
FIG. 15 is a front view of a sewing cartridge.
Figure 16:
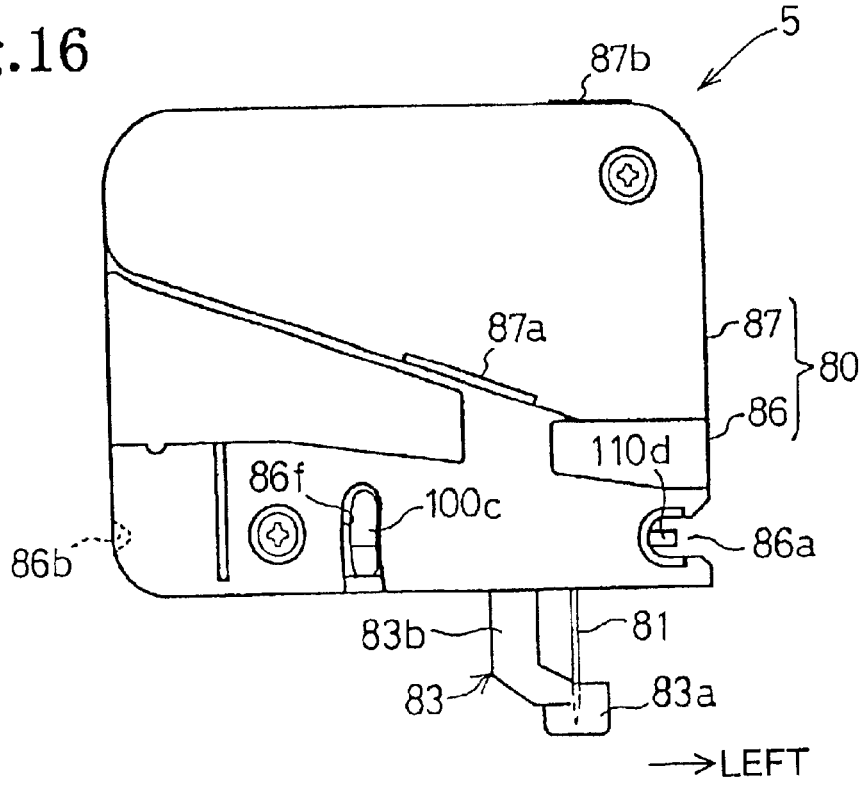
FIG. 16 a rear elevation of the sewing cartridge.
Figure 17:
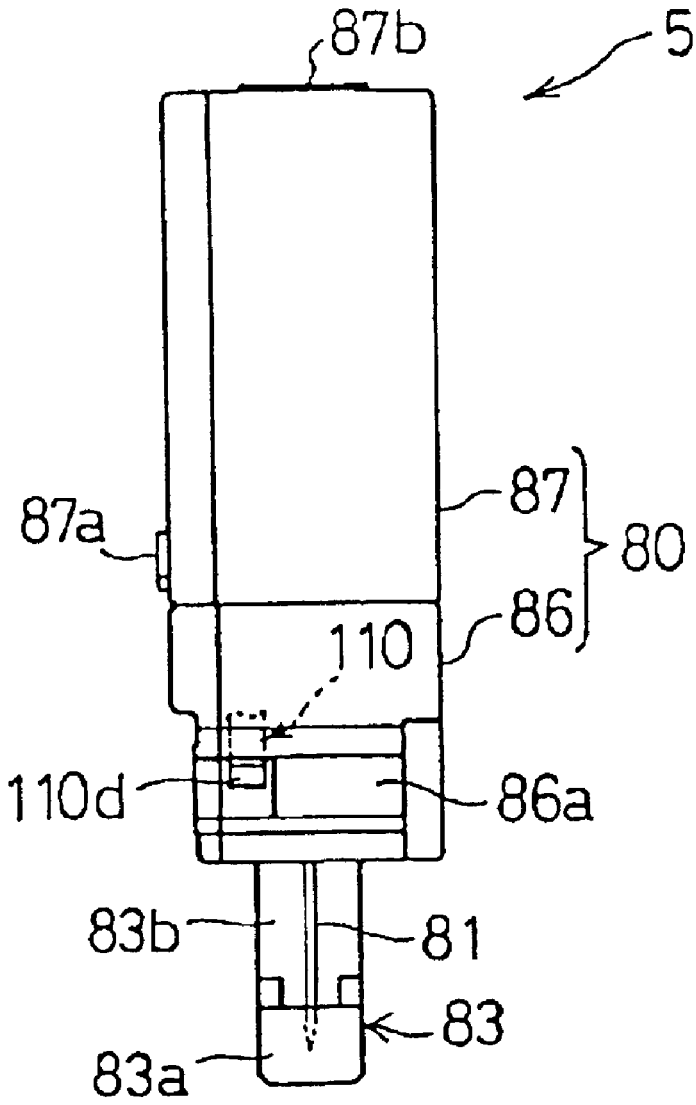
FIG. 17 is a left side view of the sewing cartridge.

The housing area 90, the excessive rotation preventive mechanism 91, and a locking member 110 of the locking mechanism 93 are provided inside the housing case 86. The thread holding mechanism 92 and an engaged portion 87*d* of the locking mechanism 93 are provided inside the openable cover 87. As shown in FIG. 15, a U-shaped engagement recess 86*a* is formed in a lower left portion (corresponding to the right portion as shown in FIGS. 18 and 19) of the housing case 86. The engagement recess 86*a* is cut away from the left and can engage the engaging pin 42 of the oscillating arm 40. A recessed engagement groove 86*b* that can engage the engaging member 44*a* provided to the oscillating arm 40, is formed in a lower right portion of the housing case 86.

Figure 22:
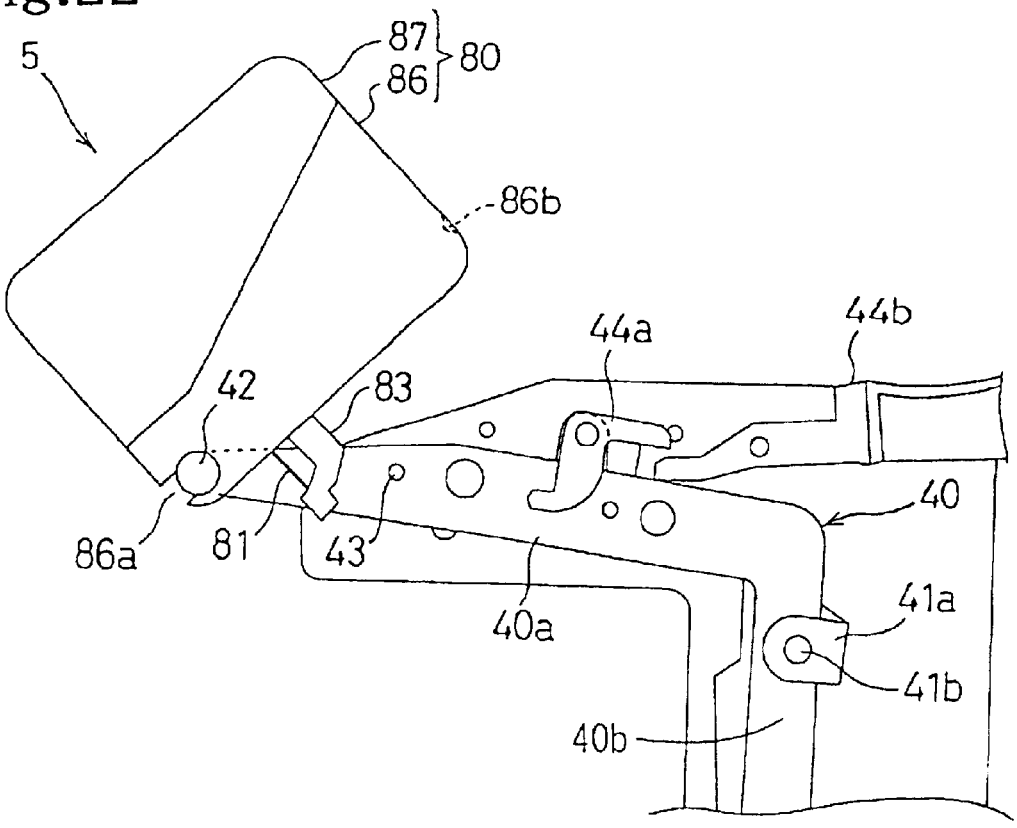
FIG. 22 is a front view of a oscillating arm and the sewing cartridge when the sewing cartridge is not completely attached to the oscillating arm.

The attachment/detachment of the sewing cartridge 5 to/from the oscillating arm 40 will be described with reference to FIG. 22. When the sewing cartridge 5 is attached to the oscillating arm 40, the sewing cartridge 5 is inserted from the cartridge insertion slot 68, formed by the forward movement of the safety cover 3, while inclined leftwardly and downwardly. The engagement recess 86*a* is engaged with the engaging pin 42, and then the sewing cartridge 5 is rotated clockwise so as to be in an attachment position where the sewing cartridge 5 is placed in a horizontal position.

Figure 23:
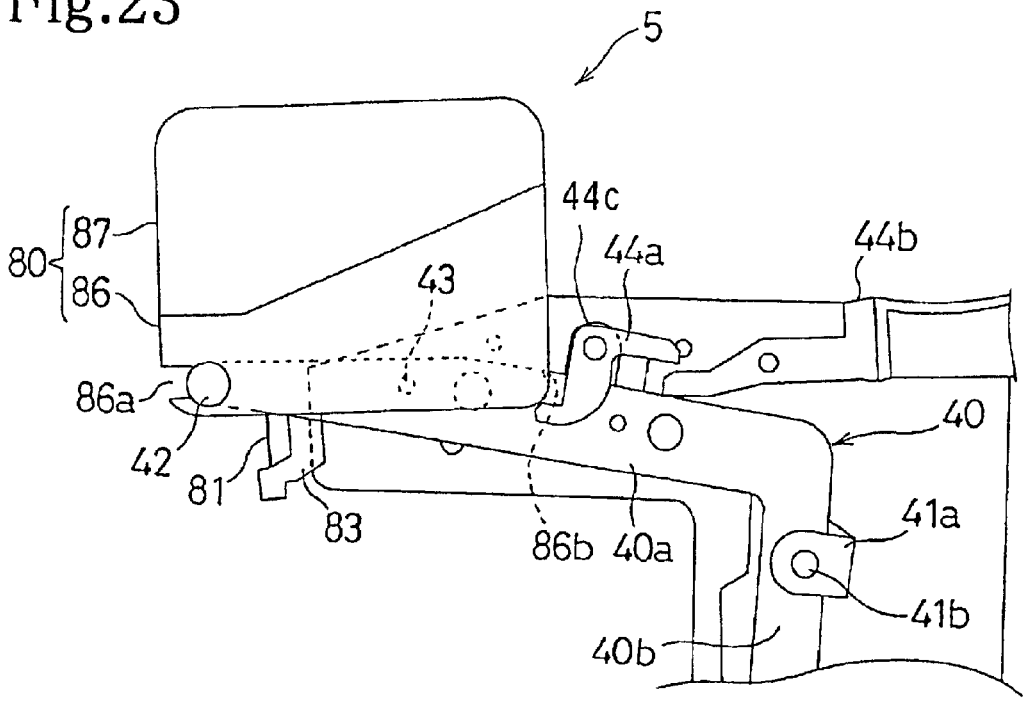
FIG. 23 is a front view of the oscillating arm and the sewing cartridge when the sewing cartridge is not completely attached to the oscillating arm.

As shown in FIG. 23, a lower right end portion of the sewing cartridge 5 contacts the engaging member 44*a* slightly before the sewing cartridge 5 reaches the horizontal position. As the sewing cartridge 5 reaches the horizontal position, the engaging member 44*a* rotates counterclockwise against an urging force from the torsion spring 44*c*. Then, the engaging member 44*a* is rotated clockwise by the urging force from the torsion spring 44*c*, so that the engaging member 44*a* is returned a small amount and engaged with the recessed engagement groove 86*b*. Thus, as shown in FIG. 24, the housing case 86 is fixedly attached to the oscillating arm 40.

The sewing cartridge 5 is attached to the oscillating arm 40 in a state where the oscillating arm 40 is in the upper limit position. As described above, when the housing case 86 is fixedly attached to the oscillating arm 40, as shown in FIGS. 7 and 24, an engaged portion 87*a* of the openable cover 87 engages the left end of the engagement plate 19 of the sewing apparatus body 2 so as to abut against it from above. Thus, the openable cover 87 is substantially fixed with respect to the sewing apparatus body 2.

Figure 24:
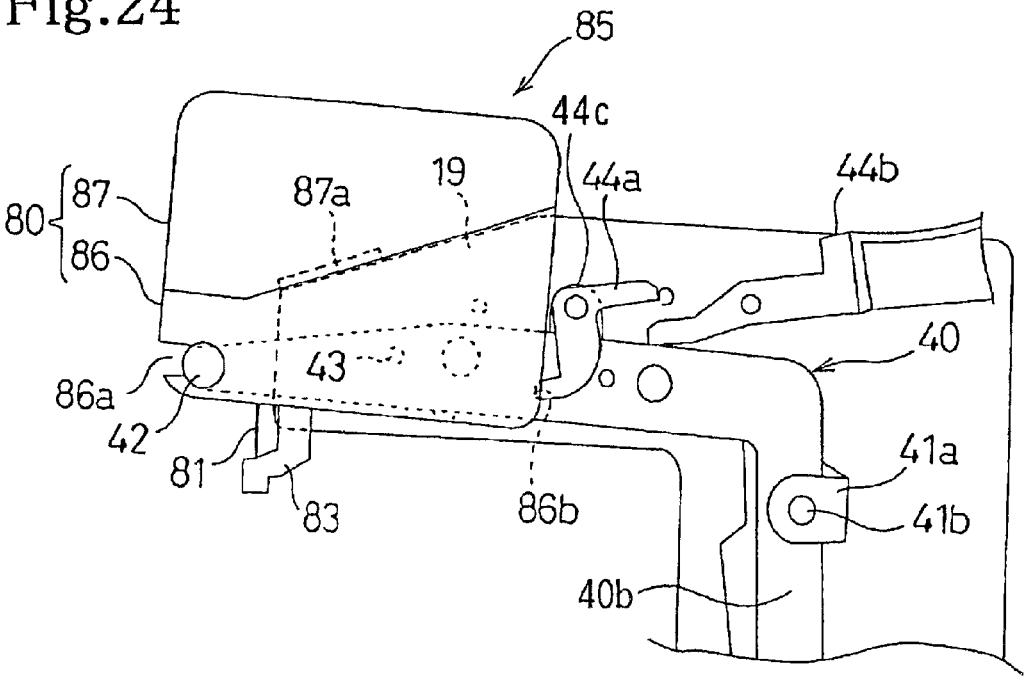
FIG. 24 is a front view of the oscillating arm and the sewing cartridge when the sewing cartridge is completely attached to the oscillating arm.
Figure 25:
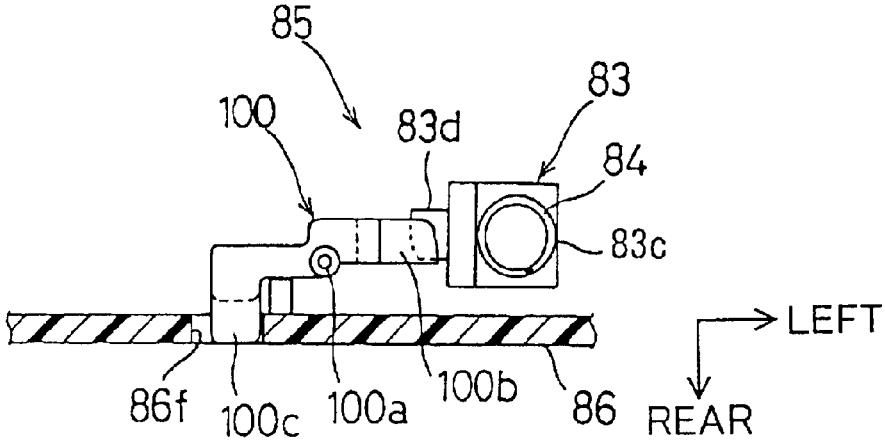
FIG. 25 is a plan view of a movement prohibiting mechanism in a locked position.
Figure 26:
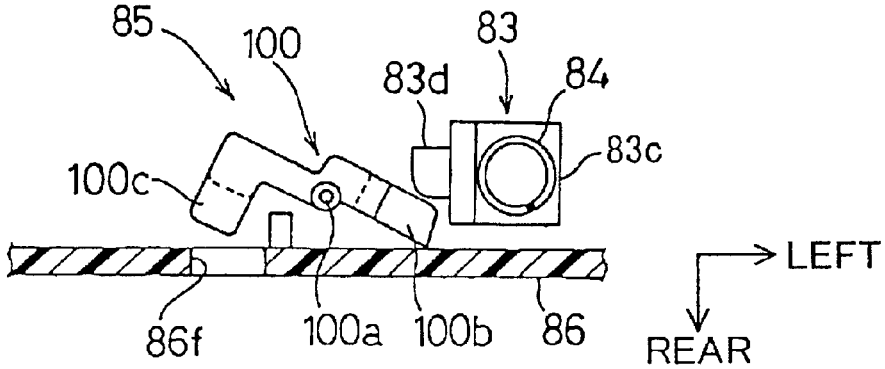
FIG. 26 is a plan view of the movement prohibiting mechanism in an unlocked position.

When the sewing cartridge 5 is detached from the oscillating arm 40, the operating member 44*b* is rotated clockwise from the state shown in FIG. 24, so that the engaging member 44*a* is rotated counterclockwise against the urging force from the torsion spring 44*c* via the operating member 44*b*. By doing so, as shown in FIG. 23, the engaging member 44*a* is disengaged from the engagement groove 86*b*. Thus, the sewing cartridge 5 can be removed from the oscillating arm 40 in a manner reverse to the operation for attaching the sewing cartridge 5 to the oscillating arm 40.

An opening 86*c* (FIGS. 2, 3 and 15) is formed in the front wall 86*j*, which corresponds to the front of the housing area 90, of the housing case 86 of the cassette body 80. A remaining amount of the thread 99 wound around the spool 82 housed in the housing area 90 can be visually confirmed from the outside through the opening 86*c*. A thread color indicating portion 87*b* (FIGS. 2, 3 and 15), that indicates a same/similar color as the color of the thread 99 wound around the spool 82, housed in the housing area 90, is provided on a top surface of the openable cover 87 of the cassette body 80, to which a color chip, that is the same as or similar to the color of the thread 99, is adhered.

Flanges 82*b* (FIG. 15) of the spool 82 are transparent or translucent. Accordingly, a remaining amount of the thread 99 wound around the spool 82 housed in the housing area 90 can be visually confirmed from the opening 86*c* through the flange 82*b*. Because the thread color indicating portion 87*b* is provided on the top surface of the openable cover 87, the thread color indicating portion 87*b* is visually exposed to the outside in a state where the sewing cartridge 5 is attached to the sewing apparatus body 2.

The hollow needle 81 is disposed at the left part (FIGS. 2, 3, 7 and 15) of the inside of the cassette body 80 in a substantially standing posture. At least the upper end portion of the hollow needle 81 is supported by a tube-like needle support member 95 (FIGS. 18 and 19) fixedly attached to the housing case 86. The lower end portion of the hollow needle 81 protrudes from the bottom of the cassette body 80. A tip of the hollow needle 81 is pointed such that the tip is inclined rightwardly and downwardly from the left to the right (FIG. 15). When the sewing cartridge 5 is installed in the sewing apparatus body 2, the hollow needle 81 is positioned so that its extreme tip faces a center-of-swing side of the oscillating arm (FIGS. 2, 3, 15, 23 and 24).

In FIG. 18, a circular wall 90*a*, which is integrally formed with the housing case 86 and protrudes therefrom, forms the housing area 90 in the right half in the housing case 86. The spool 82 housed in the housing area 90 is fit onto a shaft 90*b* of the housing case 86 and is rotatably supported by the shaft 90*b*. The thread 99 extending from the spool 82 is fed into the hole formed in the hollow needle 81 from above via the thread holding mechanism 92 from a thread passing aperture 90C formed in the circular wall 90*a*. The thread 99 is drawn to the outside of the sewing cartridge 5 from the lower end of the hollow needle 81.

The thread 99, wound around the spool 82, is not very heavy. The hole in the hollow needle 81 is formed so that the thread 99 can be threaded through the hollow needle 81. A sewing operation is performed when a certain length of the thread 99 is drawn from the lower end of the hollow needle 81.

The needle cover 83 can move between the cover position where the needle cover 83 covers the tip of the hollow needle 81 and a retracted position where the needle cover 83 retracts to a position above the cover position so that the hollow needle 81 can pass through the work cloth 70. The needle cover 83 also serves as a presser foot that holds the work cloth 70 at the time of sewing. The needle cover 83 includes a cover portion 83*a* formed in a substantially circular shape and a guided portion 83*b* extending upward from the right end of the cover portion 83*a*. The cover portion 83*a* and the guided portion 83*b* are integrated into a single part to form the needle cover 83.

The cover portion 83*a* is formed with a needle passing hole 83*c* through which the hollow needle 81 passes. The guided portion 83*b* is vertically movably guided by the housing case 86. The coil compression spring 84 is interposed between the guided portion 83*b* and the housing case 86. A protrusion 83*d*, protruding rightward, is provided at a middle portion of the guided portion 83*b* in the up and down direction. In a state where the protrusion 83*d* abuts against an upper end of a rib 86*d* that guides the guided portion 83*b* in the up and down direction, the needle cover 83 is in the cover position. Further, the tip of the hollow needle 81 is positioned inside of the needle passing hole 83*c*, so that the tip of the hollow needle 81 is covered with the cover portion 83*a*.

Figure 14:
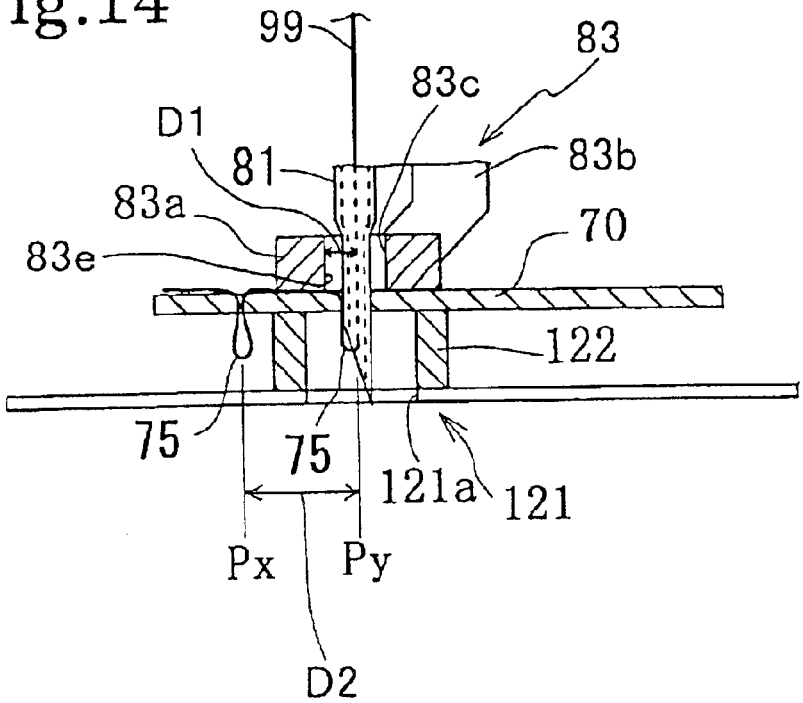
FIG. 14 is a partially expanded sectional view showing a relationship among a presser foot, the hollow needle and a needle plate.

As the needle cover 83 moves upward with respect to the hollow needle 81, the needle cover 83 is placed in the retracted position. Thus, the hollow needle 81 passes through the needle passing hole 83*c* and protrudes from the bottom of the cover portion 83*a*. As shown in FIG. 14, the needle cover 83 is structured to hold at least a part of the thread 99 from a stitch point Px, where a stitch has been previously made, to a stitch point Py, where a succeeding stitch is to be currently made. In FIG. 14, a distance D1 between the center of the hollow needle 81 and an inside wall surface 83*e* of the cover portion 83*a* is smaller than a minimum pitch D2 between the consecutive stitch points Px and Py. In this embodiment, the distance D1 is 0.75 mm and the minimum pitch D2 is 1.0 mm. Accordingly, the cover portion 83*a* can hold at least a part of the thread 99 between the previous stitch point px and the current stitch point Py. During straight stitching in a certain direction, the cover portion 83*a* of the needle cover 83 may hold the thread 99 at the previous stitch point Px when the hollow needle 81 moves to the current stitch point Py.

As shown in FIGS. 18 to 20 and 25 to 27, the movement prohibiting mechanism 85 is structured to prohibit the needle cover 83 in the cover position from moving therefrom when the sewing cartridge 5 is detached from the sewing apparatus body 2. The movement prohibiting mechanism 85 has a movement prohibiting member 100 disposed at a middle, lower portion, in the right and left direction, inside of the housing case 86. The movement prohibiting member 100 includes a vertical pivot shaft portion 100*a*, a locking portion 100*b* disposed on the right of the vertical pivot shaft portion 100*a* (FIGS. 18, 19, 20, 25 and 26) and an engaged portion 100*c*, that engages the lock release pin 43, disposed on the left of the vertical pivot shaft portion 100*a*. The vertical pivot shaft portion 100*a*, the locking portion 100*b*, and the engaged portion 100*c* are integral and form a unitary structure. In the movement prohibiting member 100, the vertical pivot shaft portion 100*a* is pivotally supported to the housing case 86, so that the movement prohibiting member 100 is rotated about the vertical pivot shaft portion 100*a*. The movement prohibiting member 100 cannot move vertically.

The locking portion 100*b* is relatively long in the up and down direction. The lower end of the locking portion 100*b* substantially abuts against an upper surface of the protrusion 83*d* of the needle cover 83 in the cover position, that is, where the lower surface of the protrusion 83*d* is abutted against the upper surface of the rib 86*d*. In this state, the locking portion 100*b* is positioned between a rib 86*e*, in the cassette body 80, and the protrusion 83*d*. Thus, the needle cover 83 is locked in the cover position, and cannot move upward. The movement prohibiting member 100 can be rotated between a locked position (see FIG. 25) and an unlocked position (see FIG. 26) where the locking portion 100*b* is moved out of the way of the up and down movement of the protrusion 83*d* between the rib 86*e* and the rib 86*d*. Therefore, when the movement prohibiting member 100 is placed in the unlocked position, the needle cover 83 can be movable if the needle cover 83 is pushed upwardly against the elastic force from the coil compressing spring 84. The needle cover 83 is pushed upwardly when the sewing cartridge 5 is moved to the sewing position by the movement of the oscillating arm 40. At that time, the needle cover 83 is pushed against the needle plate 121, having a hole through which the hollow needle 81 can pass, formed on the support frame 31, via the work cloth 70 (see FIG. 8).

A torsion spring 100*d* is attached to the pivot shaft portion 100*a*. The movement prohibiting member 100 is rotatably urged to the locked position by the torsion spring 100*d*. In a state where the sewing cartridge 5 is not attached to the sewing apparatus body 2, the movement prohibiting member 100 is maintained in the locked position. The rear wall of the housing case 86 is formed with an opening 86*f* (FIGS. 16, 25, 26 and 27) corresponding to the engaged portion 100*c* (FIGS. 18 and 19). When the movement prohibiting member 100 is in the locked position, the engaged portion 100*c* protrudes toward the outside from the opening 86*f*.

Figure 27:
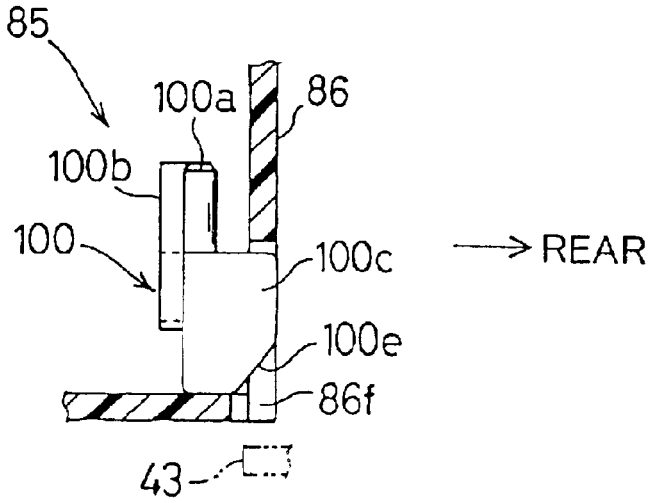
FIG. 27 is a side view of the movement prohibiting mechanism.
Figure 28:
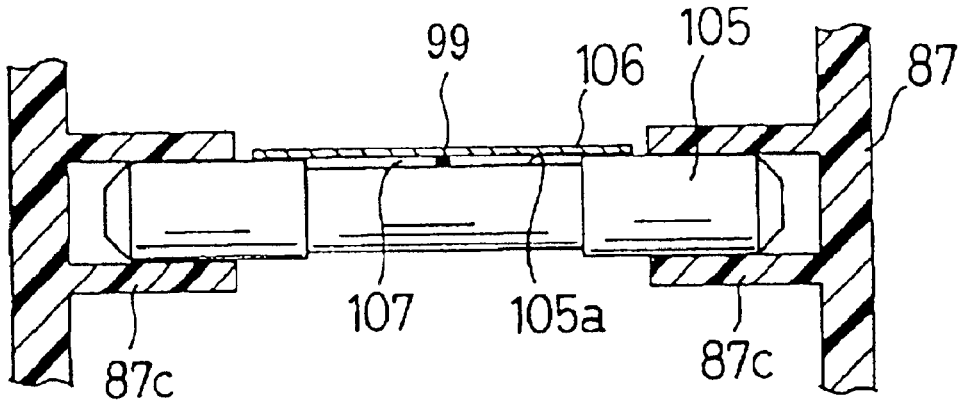
FIG. 28 is a vertical sectional view of a thread holding mechanism.
Figure 29:
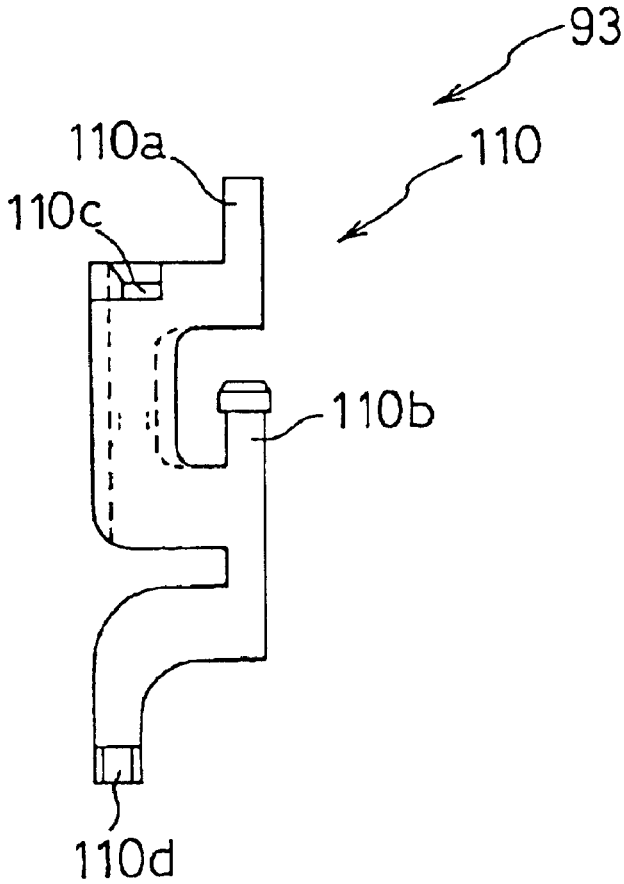
FIG. 29 is a side view of a lock member of a lock mechanism.

As shown in FIG. 27, the opening 86*f* extends to the lower wall of the housing case 86. The bottom of the engaged portion 100*c* is formed with a tapered portion 100*e* that inclines externally and upwardly. As described above, the lock release pin 43 is provided to the oscillating arm 40. When the sewing cartridge 5 is attached to the oscillating arm 40, the lock release pin 43 enters into the opening 86*f* from the bottom and engages the tapered portion 100*e* of the engaged portion 100*c*. As a result, the movement prohibiting member 100 is rotated from the locked position to the unlocked position against the urging force from the torsion spring 100*d*, so that the needle cover 83 is unlocked and can be movable upwardly as described above.

As described above, in the state where the sewing cartridge 5 is not attached to the sewing apparatus body 2, the movement prohibiting member 100 prohibits the needle cover 83 in the cover position from moving therefrom. In the state where the sewing cartridge 5 is attached to the sewing apparatus body 2, the needle cover 83 is allowed to move from the cover position to the retracted position.

Figure 20:
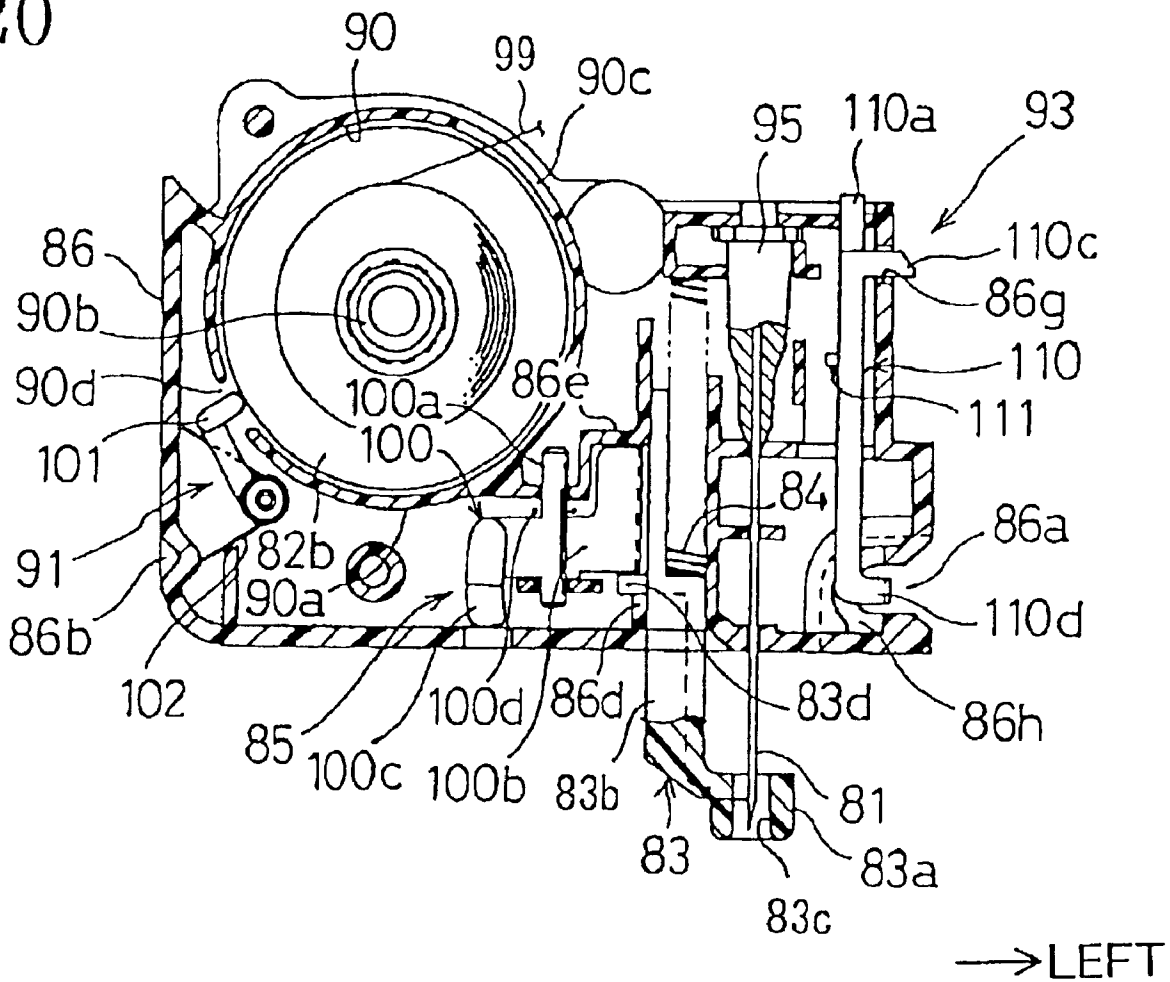
FIG. 20 is a vertical sectional view of a housing case of the sewing cartridge.
Figure 21:
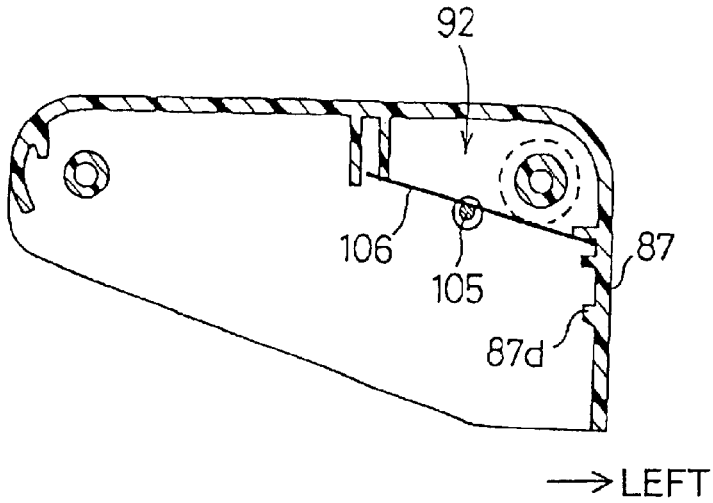
FIG. 21 is a vertical sectional view of an openable cover of the sewing cartridge.

As shown in FIGS. 18 to 20, the excessive rotation preventive mechanism 91 has a contact 101 that can contact one of the flanges 82*b* of the spool 82, and a torsion spring 102 that urges the contact 101 against the flange 82*b*. By the friction produced between the contact 101 and the flange 82*b*, the spool 82 is prevented from excessively rotating in the thread supply direction to prevent the excessive feeding of the thread 99. The contact 101 is pivotally supported by a shaft 103 disposed near the housing area 90 in the housing case 86. The shaft 103 is provided with the torsion spring 102. The tip of the contact 101 contacts the flange 82*b* of the spool 82 in the housing area 90 by passing through an aperture 90*d* formed in the circular wall 90*a*.

The thread holding mechanism 92 will be described with reference to FIGS. 18, 19, 21, and 28. The thread holding mechanism 92 has a guide pin 105 and a leaf spring 106 abutting against the guide pin 105, and is structured to be movable with respect to the hollow needle 81 and the housing area 90. Between the guide pin 105 and the leaf spring 106, a thread passing portion 107, which has extremely small clearance, is provided. The thread 99 drawn from the spool 82 is passed through the thread passing portion 107. A frictional resistance is applied to the thread 99 due to the contact of the guide pin 105 and the leaf spring 106.

Both ends of the guide pin 105 are fixed in respective bosses 87*c* (FIG. 28) formed at the left part (FIGS. 18 and 19) of the openable cover 87. The leaf spring 106 is inserted into the openable cover 87 so as to urge the guide pin 105 in a leftwardly and downwardly inclined posture. A slender portion 105*a* having a smaller diameter, is formed at the middle portion of the guide pin 105. The thread passing portion 107 is formed by the slender portion 105*a* and the leaf spring 106. Thereby, the thread 99 passing through the thread passing portion 107 has an appropriate frictional resistance applied thereto and the thread 99 can be surely guided into the hollow needle 81.

As shown in FIGS. 18 to 20 and 29, the locking mechanism 93 integrally locks the openable cover 87 to the housing case 86 in a state where the sewing cartridge 5 is not attached to the sewing apparatus body 2. The locking mechanism 93 has the locking member 110 disposed on the left of the housing case 86. The locking member 110 is formed with pivot portions 110*a*, 110*b*, an engaging portion 110*c*, and an engaged portion 110*d* as an integrated structure. The pivot portions 110*a*, 110*b* are supported to the housing case 86 such that the locking member 110 pivots about a vertical axis. The locking member 110 can be switched between the locked position (see FIG. 18) and the unlocked position (see FIG. 19).

The locking member 110 is regulated in its vertical movement. The locking member 110 is urged to the locked position by a torsion spring 111. In FIG. 18, the engaging portion 110*c* protrudes leftward from the upper portion of the locking member 110. The engaged portion 110*d* protrudes leftward from the lower end portion of the locking member 110. The engaging portion 110*c* and the engaged portion 110*d* protrude toward the left from apertures 86*g*, 86*h*, respectively, which are formed in the upper portion of the left side wall and a back wall of the engagement recess 86*a*.

When the sewing cartridge 5 is not attached to the oscillating arm 40, the openable cover 87 is in the closed position. In this state, the engaging portion 110*c* of the locking member 110 in the locked position engages the engaged portion 87*d* protruding rightward (inward) in FIG. 18 from the front wall of the openable cover 87 from the above. Accordingly, the openable cover 87 cannot be moved upward with respect to the housing case 86 and is integrally locked to the housing case 86 in the closed position.

When the sewing cartridge 5 is attached to the oscillating arm 40, as described above, the engaging pin 42 rightwardly presses (FIG. 22, for example) and moves the engaged portion 110*d* of the locking member 110 as the engagement recess 86*a* of the housing case 86 engages the engaging pin 42 of the oscillating arm 40. Therefore, the locking member 110 is switched to the unlocked position from the locked position. In this state, the engaging portion 110*c* of the locking member 110 is in the unlocked position and is disengaged from the engaged portion 87*d*. The lock is released, so that the openable cover 87 can be moved upward with respect to the housing case 86.

Usually, the sewing cartridge 5 is detached from the oscillating arm 40 in a state where the openable cover 87 is in the closed position. Therefore, the openable cover 87 is locked to the housing case 86 in the locked position immediately after the sewing cartridge 5 is detached. If the sewing cartridge 5 is detached from the oscillating arm 40 in a state where the openable cover 87 is in a position other than the closed position, the locking member 110 is switched to the locked position with the openable cover 87 unlocked. However, the openable cover 87 is rotated to the closed position by the urging force from the torsion spring 88 because a tapered portion inclined leftwardly is formed at the left end portion of the engaging portion 110*c* of the locking member 110. At that time, the engaged portion 87*d* temporarily presses and moves the locking member 110 toward the unlocked position via the tapered portion, so that the openable cover 87 can be switched to the closed position. For all of the above discussion, any direction description related to FIGS. 18–21 is the reverse of the actual directions when the sewing cartridge 5 is mounted in the sewing apparatus 1, such as shown in FIGS. 22–24, for example.

According to the sewing apparatus 1 described above, during sewing, the needle cover 83 holds the work cloth 70 and at least a part of the thread 99 between the previous stitch point Px and the current stitch point Py, and the hollow needle 81 descends through the needle passing hole 83*c* into the work cloth 70. At this time, the thread 99 remains in the work cloth 70 by a thread holding force due to elasticity of the work cloth 70. Additionally, as the cover portion 83*a* holds at least a part of the thread 99, stitching can be performed on the work cloth 70 without use of a lower thread.

The cover portion 83*a* is formed in a substantially circle shape. Thus, the cover portion 83*a* can hold at least a part of the thread 99 from the previous stitch point Px to the current stitch point Py, which horizontally extends in 360 degrees from the previous stitch point Px, regardless of how the embroidery pattern is shaped.

A frictional resistance is applied to the thread 99 extending between the thread holding mechanism 92 and the hollow needle 81 when the work cloth 70 is fed by the embroidery frame driving mechanism 11. The frictional resistance is smaller than the thread holding force of the work cloth 70. Therefore, while the hollow needle 81 penetrates into the work cloth 70 and descends to the lower limit position, the thread 99 extending from the tip of the hollow needle 81 is hardly pulled toward the reverse side of the work cloth 70 and more thread 99 is drawn from the housing area 90.

The needle plate 121 is positioned under the embroidery frame moving area 38 of the embroidery frame 4. The needle plate 121 has the passing portion 121 a through which the hollow needle 81 passes. The protruding portion 122 that protrudes upward is provided around the passing portion 121*a* of the needle plate 121. Therefore, when the hollow needle 81 penetrates in the work cloth 70 with the embroidery frame stopped, the hollow needle 81 passes through the protruding portion 122 and the passing portion 121*a*. In other words, stitching is performed while the embroidery frame 4 is supported from bottom. The hollow needle 81 is provided in the sewing cartridge 5 detachably attached to the sewing apparatus 1. Thus, the hollow needle 81 can be easily mounted in the sewing apparatus 1 by attaching the sewing cartridge 5 to the sewing apparatus 1.

When stitching is performed on the work cloth 70, in a state where the sewing cartridge 5 is attached to the oscillating arm 40, the oscillating arm 40 is driven via the gears 51 to 54 by the machine motor 45. When the gears are stopped, the oscillating arm 40 can be manually driven by manually operating the intermediate gear 52 via the inspection window 123. While the oscillating arm 40 is driven by the machine motor 45, the inspection window 123 is covered with the cover 124. This not only improves safety but also prevents dust or thread scraps from being entered from the inspection window 123.

The speed with which the oscillating arm 40 is driven upward to pull the hollow needle 81 out from the work cloth 70 is slower than the speed with which the oscillating arm 40 is driven downward to drive the hollow needle 81 into the work cloth 70. When the hollow needle 81 is pulled out from the work cloth 70 after it penetrates therein, the hollow needle 81 is prevented from being pulled out from the work cloth 70 faster than a hole formed in the work cloth 70 is closed due to elasticity of the work cloth 70. Accordingly, the thread 99 can reliably remain in the work cloth 70. The cam mechanism 55 is structured such that the speed with which the hollow needle 81 is removed from the work cloth 70 is slower than the speed with which the hollow needle 81 penetrates the work cloth 70. The speeds can be easily and desirably controlled through the cam mechanism 55, which simplifies control system.

When the work cloth 70 is set in the embroidery frame 4 before sewing, or when the work cloth 70 is removed from the embroidery frame 4 after sewing, the clamped state at the clamping member holding portion 125 is released by separating the operating members 126 and 127 of the first and second clamping members 71 and 72 in a direction opposite to each other. Thus, the work cloth 70 can be attached to or detached from the embroidery frame 4. As the edge of the work cloth 70 is enclosed with the frame 131 of cardboard, the work cloth 70 can be easily held in the embroidery frame 4. The use of the frame 131 can ease attaching and detaching the work cloth 70 and prevent the work cloth 70 from losing its shape during and after sewing and facilitate succeeding operations such as cutting after sewing. Additionally, with the use of the frame 131, a double-sided tape 77 can be detachably placed on the back of the work cloth 70. The frame 131 made of cardboard can be cut by scissors and manufactured easily at low prices.

The thread 99 does not easily come off from the work cloth 70 because the work cloth 70 has the elastic film member 73, made of urethane, which produces a thread holding force that causes a thread 99 to remain in the work cloth 70. Therefore, sewing is possible without the need of a lower thread.

The sewing operation performed in the sewing apparatus 1 and stitches to be formed on the work cloth 70 by the sewing operation will be described with reference to FIGS. 30 to 37. In a state where the embroidery frame 4 having the work cloth 70 and the sewing cartridge 5 are attached to the sewing apparatus body 2, the sewing cartridge 5 is vertically moved by the cartridge driving mechanism 12. At that time, the hollow needle 81, the needle cover 83 (when the needle cover 83 is kept away from the work cloth 70), the spool 82, and the excessive rotation preventive mechanism 91 move up and down with the housing case 86. However, the openable cover 87 is fixed with respect to the sewing apparatus body 2, so that the openable cover 87 hardly moves up and down along with the thread holding mechanism 92 mounted therein.

Figure 31:
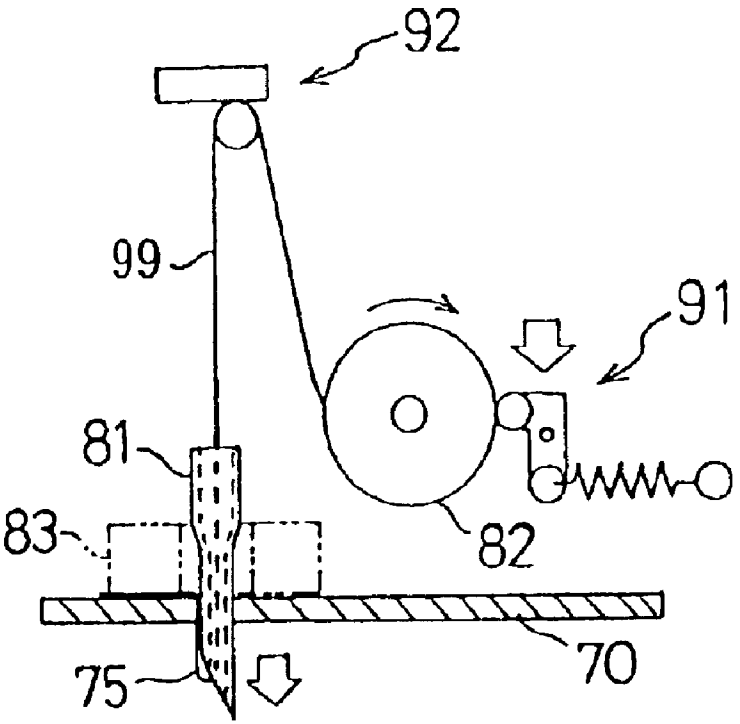
FIG. 31 is a schematic diagram of the sewing operation when a first stitching is performed.
Figure 30:
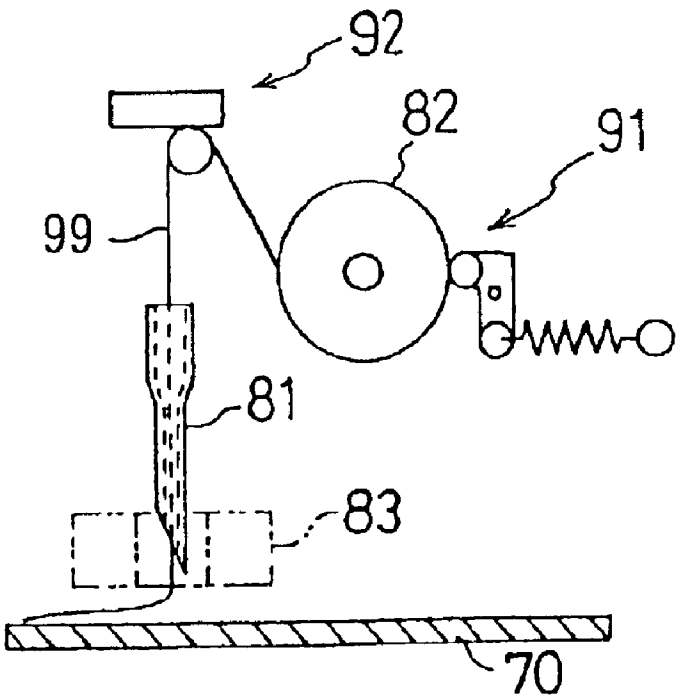
FIG. 30 is a schematic diagram of sewing operation before sewing is started.

When the sewing cartridge 5 is attached to the oscillating arm 40 and the first sewing operation is performed, as shown in FIG. 30, a certain length of a thread 99 is drawn from the lower end of the hollow needle 81. As shown in FIG. 31, when the housing case 86 descends from this state, the needle cover 83 acting as a presser foot holds the work cloth 70 and the thread 99 on the work cloth 70. When the needle cover 83 holds the work cloth 70, the needle cover 83 comes to a substantial standstill. Then, the hollow needle 81 descends with respect to the needle cover 83 and penetrates the work cloth 70. At that time, the hollow needle 81 is substantially perpendicular to the work cloth 70 at the instant when the hollow needle 81 penetrates the work cloth 70. The extreme tip of the hollow needle 81 faces the center-of-swing side of the oscillating arm 40, so that the work cloth 70 is prevented from being displaced.

When the hollow needle 81 penetrates the elastic film member 73, the thread 99 extending from the hollow needle 81 is maintained in the work cloth 70 by a thread holding force due to elasticity of the elastic film member 73. In this state, when the hollow needle 81 (the spool 82 and the excessive rotation preventive mechanism 91) further descends, the thread 99 is drawn from the spool 82 against the draw resistance for the thread 99 provided by the excessive rotation preventive mechanism 91 and the thread holding mechanism 92, and a free loop 75 is formed on a reverse side of the work cloth 70. At this stage, a half of the thread 99 forming the free loop 75 exists inside of the hollow needle 81.

While the hollow needle 81 penetrates the work cloth 70 and descends to a lower limit position, the thread 99 extending from the hollow needle 81 is pulled toward the reverse side of the work cloth 70 and more thread 99 is drawn from the spool 82. Thus, the free loop 75 is formed on the reverse side of the work cloth 70. Further, the thread 99 is prevented from being pulled toward the reverse side of the work cloth 70 before the hollow needle 81 penetrates the work cloth 70, if the thread 99 extending from the hollow needle 81 is held between the needle cover 83 and the work cloth 70.

The resistance to drawing the thread 99 produced by the excessive rotation preventive mechanism 91 and the thread holding mechanism 92 is smaller than the thread holding force. Thus, if the needle cover 83 does not hold the thread 99, the thread 99 will not come out from the work cloth 70.

Figure 32:
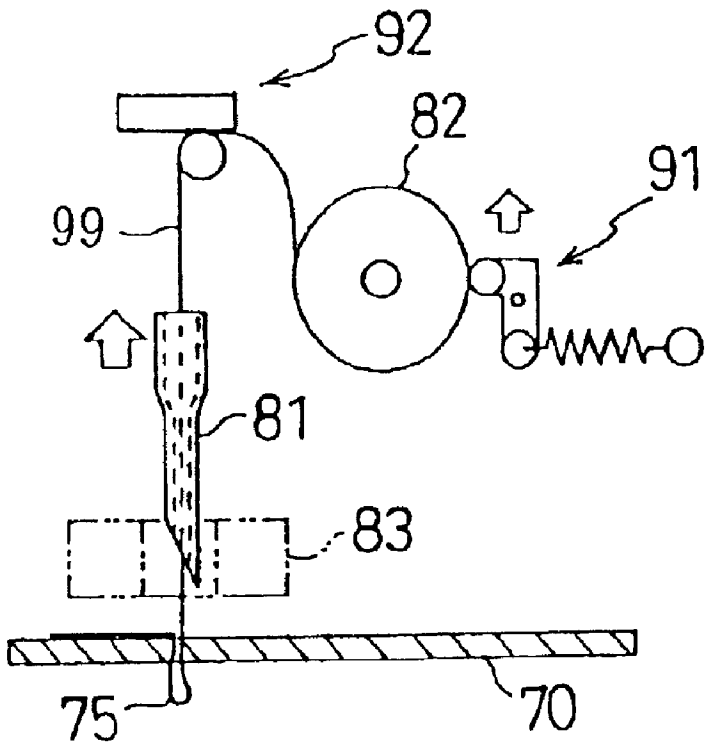
FIG. 32 is a schematic diagram of the sewing operation when the hollow needle has risen immediately after the first stitch is made.

Next, when the housing case 86 is moved upward, as shown in FIG. 32, the hollow needle 81 ascends from the lower limit position and the tip of the hollow needle 81 is pulled from the work cloth 70. Then, the work cloth 70, held by the needle cover 83, becomes free from the pressure and the needle cover 83 ascends to an upper limit position together with the hollow needle 81. At that time, only the hollow needle 81 ascends while the thread 99 is fixed or set between the thread holding mechanism 92 stopped in a certain position and the work cloth 70. The free loop 75 formed on the reverse side of the work cloth 70 is held and the entire free loop 75 is exposed externally. When the hollow needle 81 moves to the upper limit position, the spool 82 and the excessive rotation preventive mechanism 91 also move to the upper limit position. At that time, the thread 99 is not drawn from the thread holding mechanism 92 to the hollow needle 81, and the thread holding mechanism 92 and the excessive rotation preventive mechanism 91 apply resistance to drawing the thread to the thread 99. Accordingly, the thread 99 extending between the spool 82 and the thread holding mechanism 92 becomes loosened.

Figure 33:
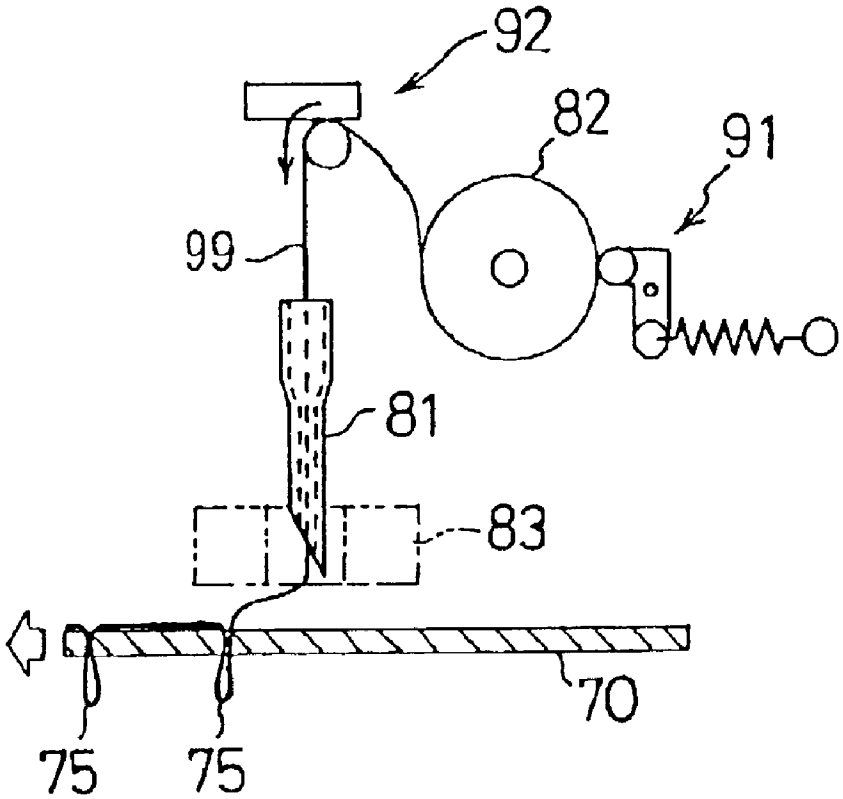
FIG. 33 is a schematic diagram of the sewing operation when a work cloth is fed.

Then, as shown in FIG. 33, as the work cloth 70 is moved in a horizontal direction, the thread 99 is pulled by the thread holding force and the loosened thread 99 extending between the spool 82 and the thread holding mechanism 92 is pulled via the thread holding mechanism 92 because the thread 99 extending from the hollow needle 81 is held by the work cloth 70. At that time, frictional resistance applied to the thread 99 by the thread holding mechanism 92 and the hollow needle 81 when the work cloth 70 is moved by the embroidery frame driving mechanism 11 is far smaller than the thread holding force by the work cloth 70. Therefore, there is no possibility that the thread 99 in the free loop 75 is pulled toward the hollow needle 81 side and finally lost.

Figure 34:
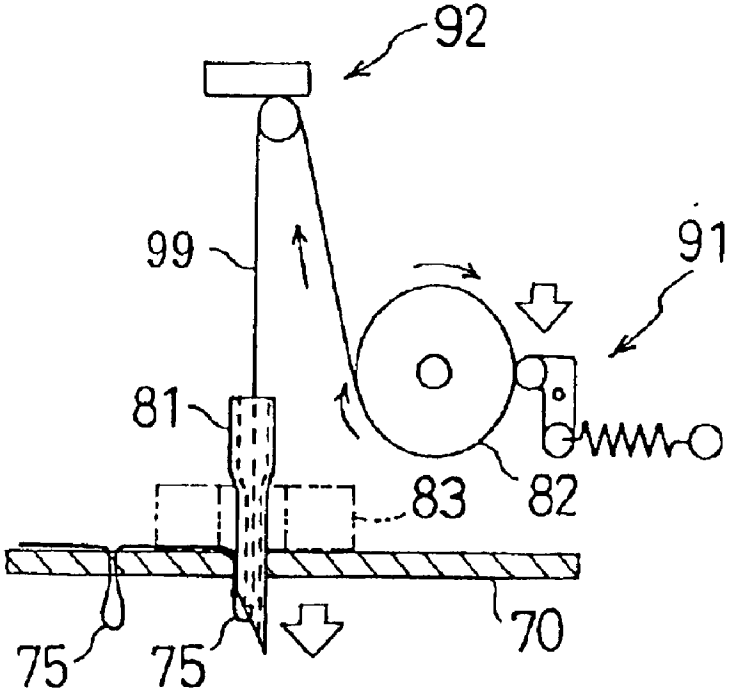
FIG. 34 is a schematic diagram of the sewing operation when a second or following stitching is performed.

After the work cloth 70 is moved in the horizontal direction, the housing case 86 descends, and the needle cover 83 holds the work cloth 70 and the hollow needle 81 penetrates the work cloth 70 as shown in FIG. 34. While the hollow needle 81 descends from the upper limit position to the lower limit position, the remaining loosened thread 99 extending between the spool 82 and the thread holding mechanism 92 is pulled and then the thread 99 is drawn from the spool 82. Resistance is applied to the drawn thread 99 by drawing the thread by the excessive rotation preventive mechanism 91 and the thread holding mechanism 92. As described above, the resistance to drawing the thread is smaller than the thread holding force of the work cloth 70. Further, thread 99 can be pressed against the work cloth 70 by the needle cover 83. Accordingly, a new free loop 75 is formed without pulling the previous free loop 75 from the work cloth 70.

Figure 35:
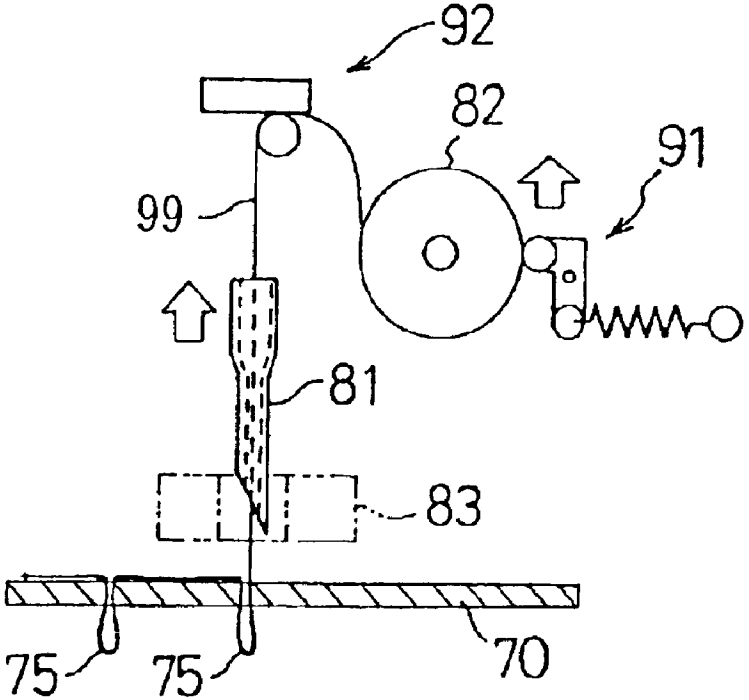
FIG. 35 is a schematic diagram of the sewing operation when the hollow needle has risen immediately after the second or following stitching is made.
Figure 36:
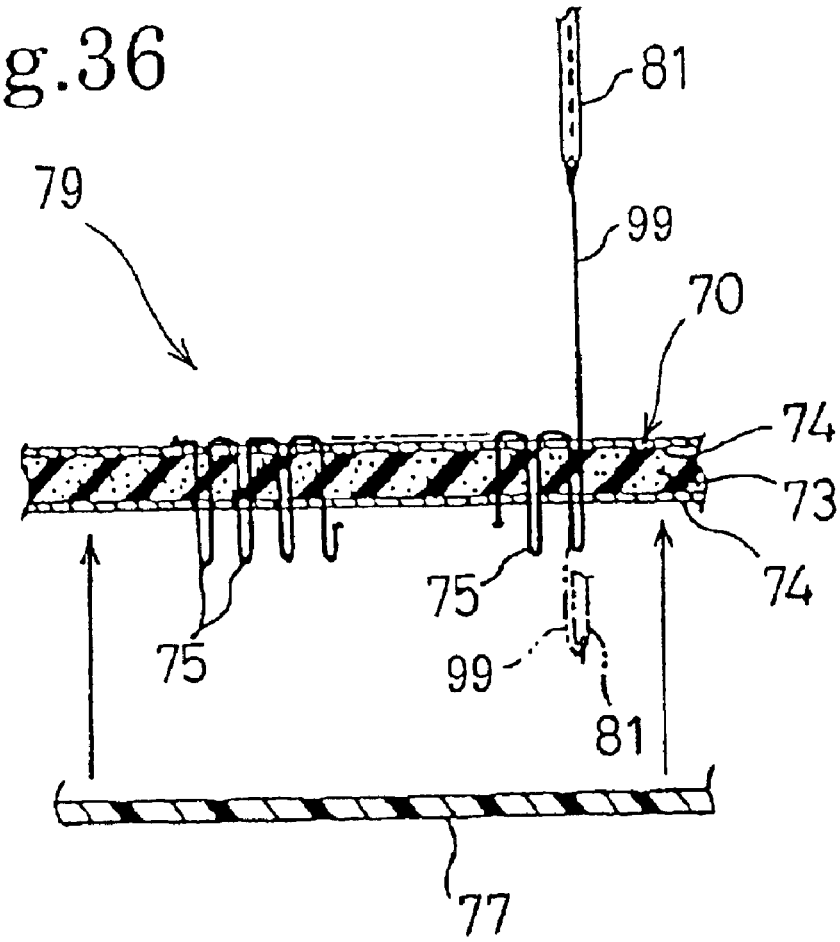
FIG. 36 is a sectional view of the work cloth, an embroidery pattern formed on the work cloth, and a double-sided adhesive tape.
Figure 37:
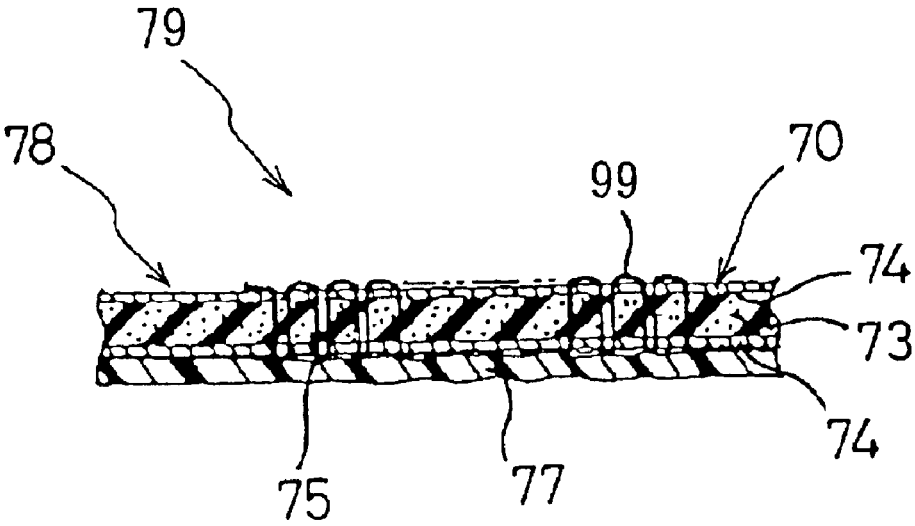
FIG. 37 is a sectional view of the work cloth on which the embroidery pattern is formed.

Next, as shown in FIG. 35, the hollow needle 81 and the needle cover 83 ascend. Then, the operations shown in FIGS. 33 to 35 are repeatedly performed. As described above, the thread 99 is left in the work cloth 70 during every sewing operation by the thread holding force produced by the elasticity of the work cloth 70 and a plurality of free loops 75 are formed on the reverse side of the work cloth 70 by the thread 99, as shown in FIG. 36. Thus, stitches forming an embroidery pattern 79 are formed on the surface of the work cloth 70. When a double-sided adhesive tape 77 is adhered to fix the free loops 75 on the reverse side of the work cloth 70, a patterned cloth 78, as shown in FIG. 37, is obtained.

Accordingly, the free loops 75 do not come off or out, so that the thread 99 does not need to be fixed by other thread or the thread of the previous stitch and following stitch. The embroidery pattern 79 formed on the work cloth 70 is stable without unraveling. The patterned cloth 78 can be attached to various things via the double-sided adhesive tape 77 as an emblem. Instead of the double-sided adhesive tape 77, adhesive agent may be applied to the reverse side of the work cloth 70 in layers. A tape may be formed of the adhesive agent and the tape may be used to fix the free loops 75 on the reverse side of the work cloth 70.

There are a plurality of free loops 75 on the reverse side of the work cloth 70. Accordingly, unevenness may develop in the double-sided adhesive tape 77 when the double-sided adhesive tape 77 is adhered to the reverse side of the work cloth 77. When the work cloth 70 is adhered to clothes via the double-sided adhesive tape 77 as an emblem, the emblem is liable to come off because the cloth is soft. However, adhesion of the work cloth 70 can be improved because of the unevenness of the double-sided adhesive tape 77. The unevenness develops at every free loop or every several free loops depending on the materials of the thread and the double-sided adhesive tape used.

According to the sewing cartridge 5 described above, the needle cover 83 can cover at least the tip of the hollow needle 81 in both states where the sewing cartridge 5 is attached to and detached from the sewing apparatus body 2. Further, the needle cover 83 placed at a cover position can be inhibited from moving therefrom by the movement prohibiting mechanism 85, so that the tip of the hollow needle 81 can be prevented from being exposed to the outside due to careless handling. Accordingly, particularly when the sewing cartridge 5 is attached to or detached from the sewing apparatus body 2, damage to clothes due to the hollow needle 81 can be prevented and the sewing cartridge 5 can be easily and safely handled.

The hollow needle 81 is fixedly provided so that the portion of the tip side of the hollow needle 81 protrudes from the cassette body 80. Sewing operations can be performed by which the hollow needle 81 vertically reciprocates with the sewing cartridge 5 and the hollow needle 81 passes through the work cloth 70. Further, the needle cover 83 also serves as a presser foot. Therefore, a small sewing cartridge 5 having a simple structure can be provided. Further, the mechanism that reciprocates the hollow needle 81 (the sewing cartridge 5) can be simplified, thereby contributing to miniaturization of the sewing apparatus 1.

The structure of the sewing cartridge 5 may be partially changed as follows.

The needle cover 83 may be structured such that the position of the needle cover 83 is manually switched between a cover position and a retracted position. In this case, the coil compression spring 84 that urges the needle cover 83 to the cover position can be removed.

Instead of the hollow needle 81, a standard sewing needle may be used.

The excessive rotation preventive mechanism 91 may be structured such that frictional resistance is produced by which a spool holder or other member or portion makes contact with the spool 82, instead of by which the contact 101 urged by the torsion spring 102 is pressed against the flange 82*b* of the spool 82.

In the thread holding mechanism 92, a recess may be formed in the leaf spring 106 to provide a thread passing portion, instead of forming the slender portion 105*a* in the guide pin 105.

Instead of forming the opening 86*c*, at least one of the housing case 86 and the openable cover 87 may be formed of a transparent or a translucent material so that the remaining amount of the thread 99 can be visually confirmed from outside through the housing case 86 and/or the openable cover 87.

The thread color indicating portion 87*b* may be provided to a portion other than the top surface of the openable cover 87 of the cassette body 80. As the thread color indicating portion 87*b*, the cassette body 80 may be partially or entirely colored with a same/similar color as the color of the thread 99 wound around the spool 82 contained in the cassette body 80.

Figure 38:
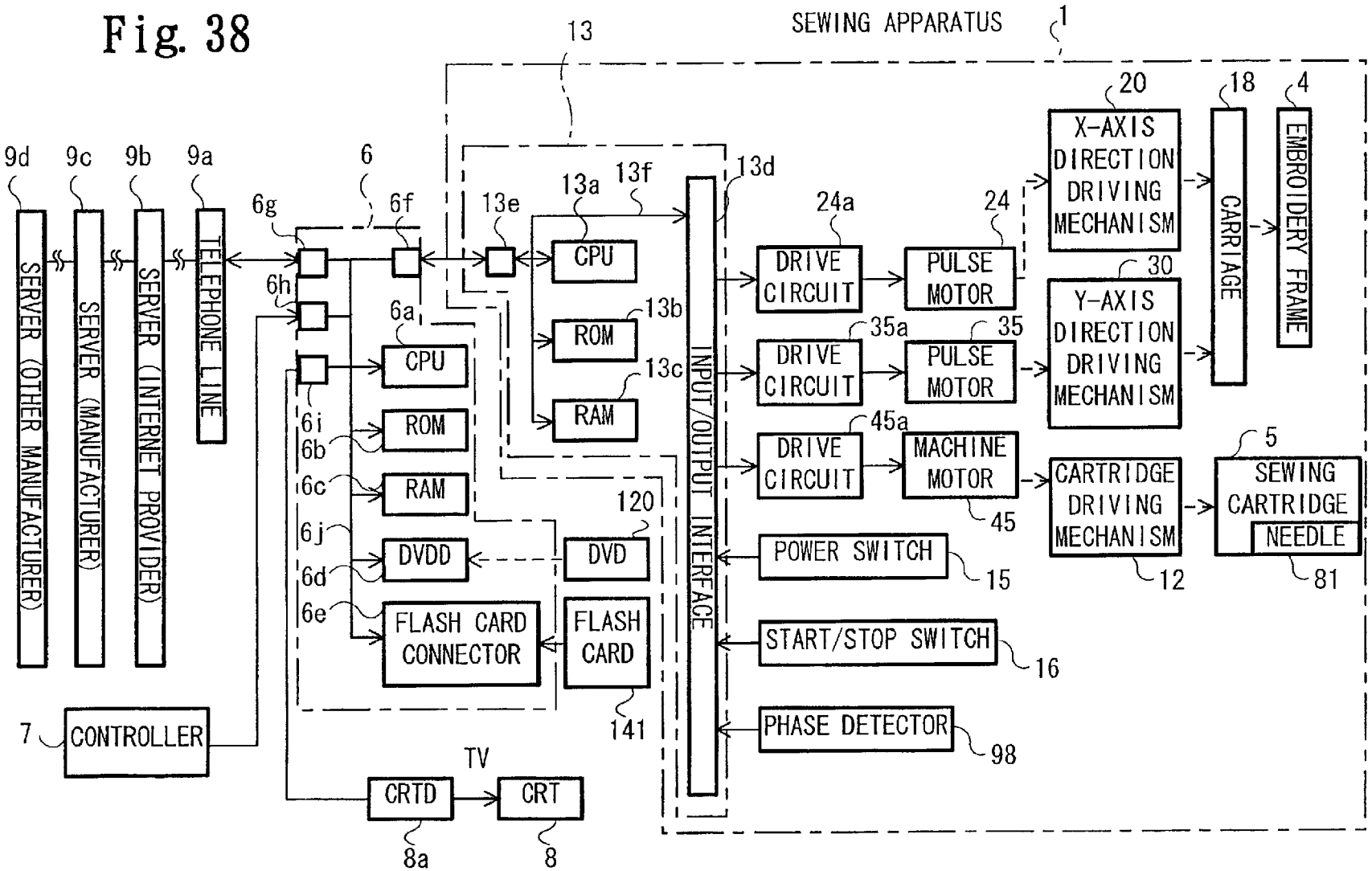
FIG. 38 is a block diagram of a control system of the sewing apparatus and the video game machine.

A control system will be described with reference to FIG. 38. The operational controller 13 of the sewing apparatus 1 has a computer including a CPU 13*a*, a ROM 13*b*, and a RAM 13*c*, an input/output interface 13*d*, and an input/output terminal 13*e*. The CPU 13*a*, the ROM 13*b*, the RAM 13*c*, the input/output interface 13*d*, and the input/output terminal 13*e* are connected to each other via a bus 13*f*. The input/output interface 13*d* is connected with a drive circuit 24*a* for the pulse motor 24 of the X-axis direction driving mechanism 20, a drive circuit 35*a* for the pulse motor 35 of the Y-axis direction driving mechanism 30, a drive circuit 45*a* for the machine motor 45 of the cartridge driving mechanism 12, the power switch 15, the start/stop switch 16, and a phase detector 98.

The phase detector 98 includes a plurality of photo interrupters and encoder disks which are fixedly attached to the pivot shaft integrally rotating with the large-diameter gear 54 and correspond to the photo interrupters. The phase detector 98 detects a rotational phase of the pivot shaft, so that an upper limit position, a lower limit position, and an unthreading position of the oscillating arm 40 can be detected.

The game machine 6 has a computer including a CPU 6*a*, a ROM 6*b* and a RAM 6*c*, a DVD drive (DVDD) 6*d* capable of reading and writing a DVD 120, a flash card connector 6*e*, input/output terminals 6*f*, 6*g*, an input terminal 6*h*, and an output terminal 6*i*, which are connected each other via bus 6*j*. The input/output terminal 6*f* is connected to the input/output terminal 13*e* of the sewing apparatus 1. The controller 7 is connected to the input terminal 6*h*. The output terminal 6*i* is connected with a drive circuit (CRTD) 8*a* for the display (CRT) 8. The drive circuit 8*a* and display 8 could also be an LCD drive and display. The input/output terminal 6*g* can be connected with a telephone line 9*a*.

The DVD 120, as an external storage medium, stores various sewing data and programs so that the sewing data and the programs are readable by the computer. The DVD 120 can be attached to or detached from the DVD drive 6*d*. When a DVD 120 storing game software for a video game is installed in the DVD drive 6*d*, a game screen is displayed on the display 8 according to the game software and a user can enjoy playing the game using the controller 7. Further, by connecting the input/output terminal 9*g* to the telephone line 9*a*, the sewing apparatus 1 can capture various data regarding sewing via the telephone line 9*a*, through a server 9*b* of an Internet provider, from a server 9*c* of a manufacturer of data and programs or a server 9*d* of another manufacturer. That is, various data regarding sewing provided from the manufacturers can be captured via the Internet 406.

A homepage of a manufacturer is not necessary to be established on a server in a country where a game machine or a terminal for sewing exists. The homepage may be established on a server in another country if the homepage can be accessed through the Internet using a connection, such as a telephone line. For example, a front homepage which is a "HOME" of a company is established on a server 9*d* in the U.S. A homepage of the same company or a related company or a private homepage is established on a server 9*d* in a country other than the U.S. (for example, European countries) so that control programs regarding sewing, control signals, and data can be sent from their homepage. The control programs, the control signals, and the data may be distributed worldwide via the Internet by which the home page in the U.S. is linked to the homepage in the other country.

In the sewing apparatus 1, an embroidery pattern can be formed on the work cloth 70 by controlling the embroidery frame driving mechanism 11 (the X-axis direction driving mechanism 20 and the Y-axis direction driving mechanism 30) and the cartridge driving mechanism 12 by the operational controller 13 based on the sewing data. A control program for sewing is stored in the ROM 13*b*. In the embodiment, various characters (e.g., persons, animals, and robots) to be displayed on the display 8 by the game software can be selected and edited using the game machine 6. Pattern data for sewing a selected/edited character can be created in the game machine 6 and can be supplied to the sewing apparatus 1.

Figure 39:
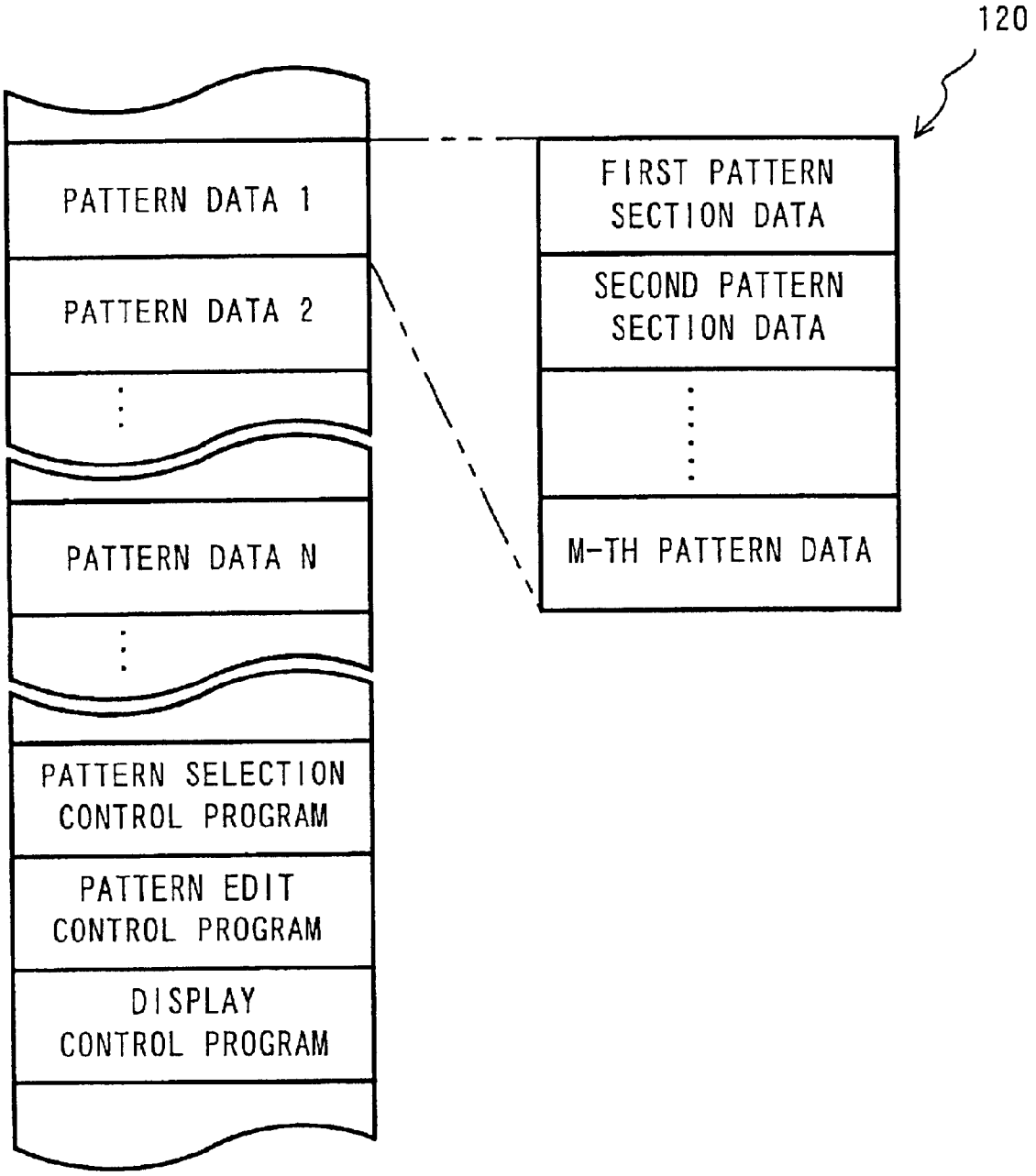
FIG. 39 is a diagram showing data stored in a DVD.

Therefore, the DVD 120 for selecting/editing sewing data is provided for the game machine 6. That is, as shown in FIG. 39, the DVD 120 stores various kinds of embroidery patterns selected from game software as described above, pattern data of various kinds for prestored embroidery patterns, a pattern selection control program for selecting a desired embroidery pattern from the various kinds of embroidery patterns, a pattern edit control program for editing (e.g., enlargement, reduction, unification, and reversal) a selected embroidery pattern, and a display control program for displaying an embroidery pattern on the display 8 for selecting and setting. A flash card 141, connectable to the flash card connector 6*e*, can store pattern data of a selected/edited embroidery pattern.

The DVD 120 also stores a pattern data creation control program for creating pattern data by selecting/editing a character of game software based on data of the game software. When pattern data is created using the pattern data creation control program, first, the control program is downloaded into the RAM 6*c*, and then various kinds of characters are displayed by running the game software DVD. A character to be sewn is selected/edited, and pattern data for the character to be sewn is created. The created pattern data is stored in the DVD 120.

Next, a series of operations of the sewing apparatus 1 described above will be described with reference to the flowcharts of FIGS. 40 and 41. As shown in FIG. 1, it is assumed that the sewing apparatus I is connected with the game machine 6 via a connecting cable and the DVD 120 storing data of FIG. 39 is installed in the DVD drive 6*d* of the game machine 6. The game machine 6 is connected to the display 8 via the connecting cable.

First, an embroidery pattern is selected/edited using the controller 7 of the game machine 6 while observing a screen on the display 8. The embroidery pattern can be selected/edited without turning the power of the sewing apparatus 1 on.

Figure 40:
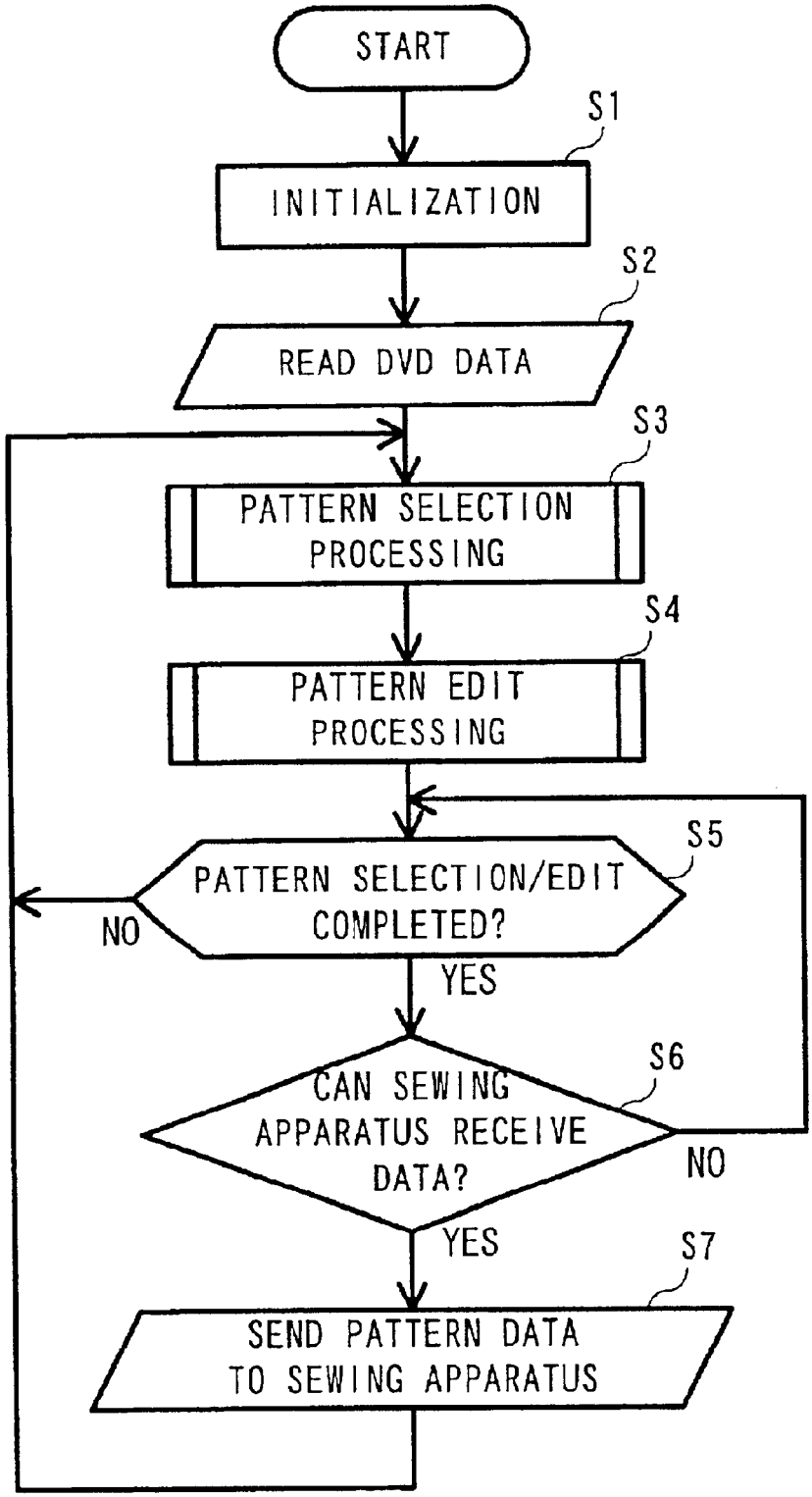
FIG. 40 is a flowchart of control to be executed in the video game machine.

As shown in FIG. 40, in a controller of the game machine 6, control is started when the power of the game machine 6 is turned on. After initialization (S1) (S stands for a step), data in the DVD 120 (such as the pattern selection control program, the pattern edit control program, and the display control program) are read (S2). Then, in pattern selection processing (S3), a desired embroidery pattern can be selected from various kinds of embroidery patterns stored in the DVD 120. In pattern edit processing (S4), a selected embroidery pattern can be edited (e.g., enlargement, reduction, unification, and reversal).

Selection/edit of the embroidery data is completed by operating a predetermined button of the controller 7 (S5;Yes). Then, when the sewing apparatus 1 can accept data (S6;Yes), the pattern data of the selected/edited embroidery pattern is sent to the sewing apparatus 1 (S7). After that, flow is returned to S3. When the sewing apparatus 1 cannot receive data, such that the power of the sewing apparatus 1 is not turned on (S6;No), flow returns to S5.

Figure 41:
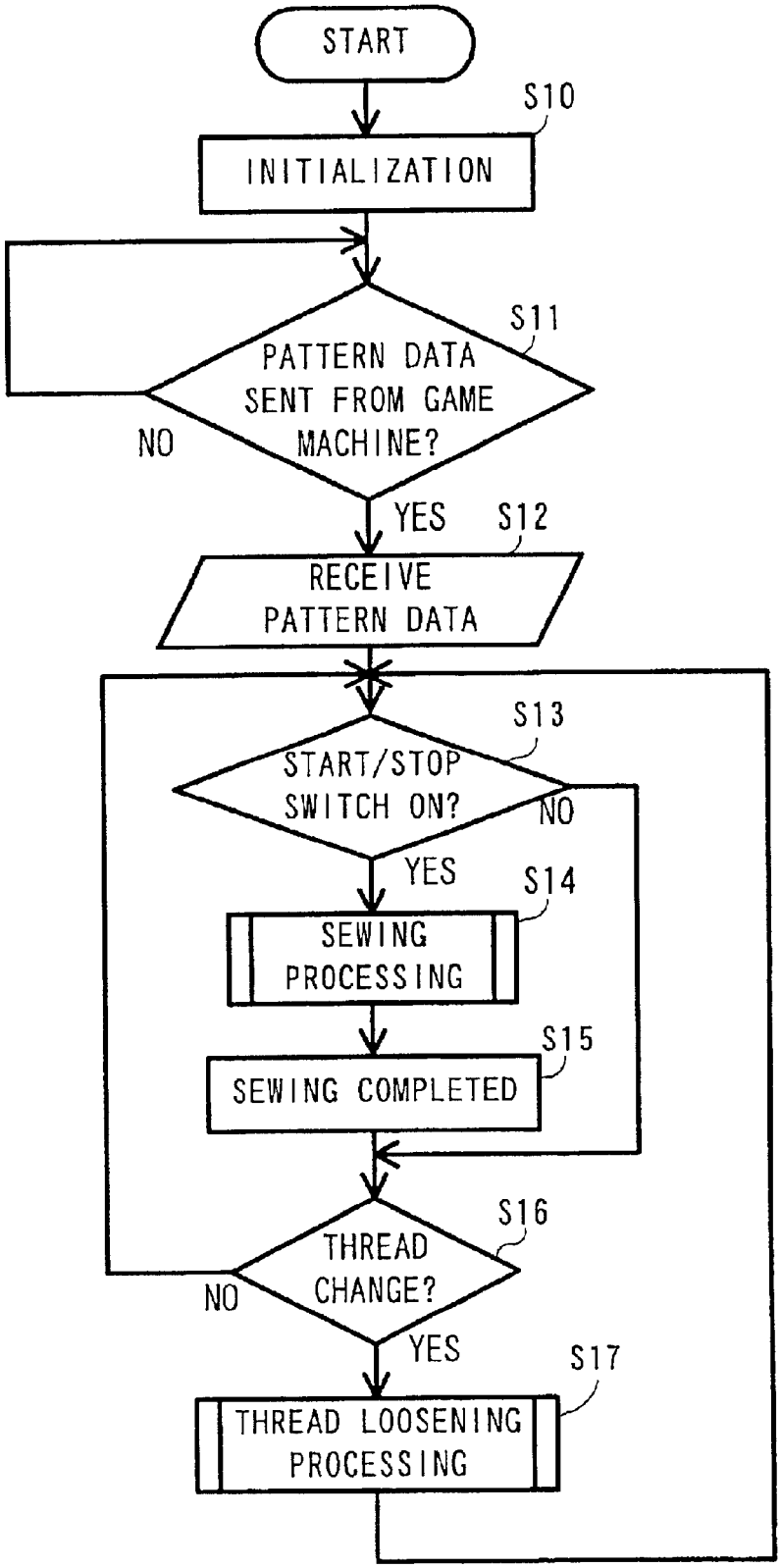
FIG. 41 is a flowchart of control to be executed in the sewing apparatus.

As shown in FIG. 41, in the operational controller 13 of the sewing apparatus 1, control is started when the power switch 15 is turned on. After initialization (S10), the sewing apparatus 1 can receive data. When the selected/edited pattern data is sent from the game machine 6 (S11;Yes), the sewing apparatus 1 receives the pattern data (S12). Next, when the start/stop switch 16 is turned on (S13;Yes), sewing processing is performed based on the received pattern data (S14).

Preparation required prior to starting the sewing operation will now be described. In a state where the safety cover 3 of the sewing apparatus 1 is in the storage position shown in FIG. 2, the embroidery frame 4 having the work cloth 70 is inserted into the inside of the safety cover 3 from the embroidery frame insertion slot 3*f* while the embroidery frame 4 is guided by the guide member 69 of the safety cover 3. The installation portion 4*a* of the embroidery frame 4 is engaged with the engagement portion 18*a* of the carriage 18. As described above, the carriage 18 in which the embroidery frame 4 can be securely attached is positioned substantially under the oscillating arm 40. At initialization (S10), the carriage 18 is moved to this position and placed on standby. The safety cover 3 is in the storage position and the embroidery frame 4 slightly protrudes from the safety cover 3.

After the embroidery frame 4 is attached to the carriage 18, the guide member 69 is grasped and the safety cover 3 is slid forward so as to be placed in the sewing position shown in FIG. 3. In this state, the cartridge insertion slot 68 is formed by the safety cover 3 and the casing 10. The sewing cartridge 5, accommodating a thread of a desired color, is inserted into the inside of the safety cover 3 from the cartridge insertion slot 68 and is attached to the oscillating arm 40. After this preparation is completed, the sewing process can be performed.

When the safety cover 3 is in a position other than the sewing position, the start/stop switch 16 cannot be operated because the start/stop switch 16 is covered with the safety cover 3. When the safety cover 3 is switched to the sewing position, the start/stop switch 16 is opposed to the switch operating hole 3*e*, so that the start/stop switch 16 can be operated. When the start/stop switch 16 is turned on (S13;Yes), the sewing processing (S14) is performed.

As shown in FIG. 39, pattern data of each embroidery pattern stored in the DVD 120 includes pattern section data of several pattern sections. The sewing cartridge is changed for every pattern section to change a thread color. That is, as shown in FIG. 41, when the start/stop switch 16 is turned on (S13;Yes), the sewing processing (S14) is performed. Based on the pattern data of one pattern section, the embroidery frame driving mechanism 11 and the cartridge driving mechanism 12 are controlled and the pattern section is sewn on the work cloth 70.

When one pattern section is formed, the sewing operation of the pattern section is finished (S15). When a pattern section to be sewn next has a different color, the sewing cartridge 5 is changed to a sewing cartridge 5 that has a thread having a color for a pattern section to be sewn. In this case, for example, when a thread change is commanded by operating a predetermined button of the controller 7 (S16;Yes) before the sewing cartridge 5 presently attached to the sewing apparatus body 2 is detached therefrom, thread loosening processing (S17) is performed in order to cut the thread and change the sewing cartridge 5.

When it is not necessary to change the sewing cartridge 5, the thread loosening processing at S17 does not need to be performed. That is, when the thread change is not commanded (S16;No), flow returns to S13. Accordingly, the start/stop switch 16 is turned on (S13;Yes) while the sewing operation is stopped (S15), the sewing operation (S14) is started again. Thus, the next pattern section is formed.

During the thread loosening process (S17), the embroidery frame 4 is moved from a sewing end position to a moving limit position within the embroidery frame moving area 38 (see FIG. 6) after the sewing operation is completed. Then, the embroidery frame driving mechanism 11 is controlled so as to loosen the thread 99 extending between the hollow needle 81 and the work cloth 70, in order to draw the thread 99 from the spool 82 in the sewing cartridge 5. The thread loosening control program is stored in the ROM 13*b* in the operational controller 13 of the sewing apparatus 1. The thread loosening control program may be stored in other kinds of storage media, such as the DVD 120, and may be transferred to the sewing apparatus 1.

Figure 42A:
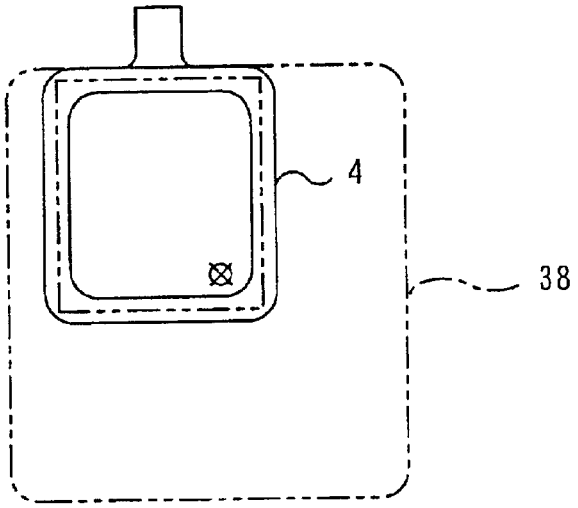
FIG. 42A is a plan view of a sewing end position of the embroidery frame with respect to an embroidery frame moving area.
Figure 42B:
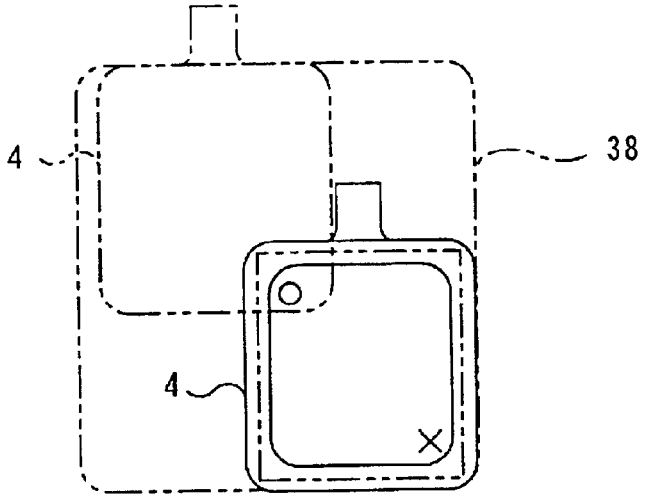
FIG. 42B is a plan view of a moving limit position of the embroidery frame with respect to the embroidery frame moving area.
Figure 42C:
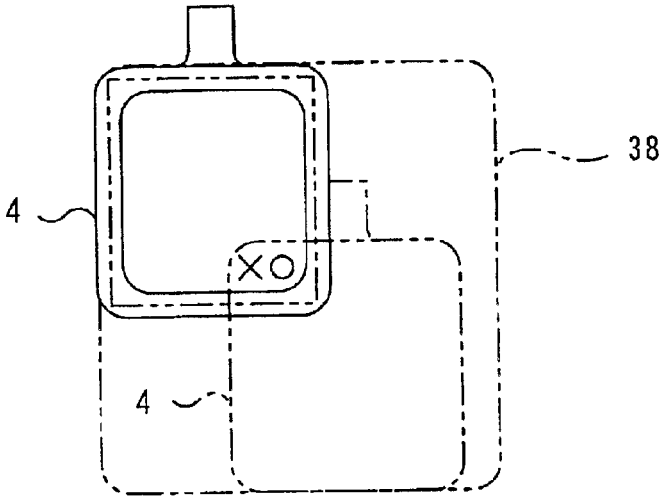
FIG. 42C is a plan view of a moving limit position of the embroidery frame with respect to the embroidery frame moving area.

FIG. 42A shows a sewing end position of the embroidery frame 4 immediately after sewing operation of one pattern section is completed. In FIGS. 42A to 42C, "O" indicates a stitch position of the hollow needle 81 positioned substantially in a center of the embroidery frame moving area 38. "X" indicates a last stitch position where the hollow needle 81 penetrates the work cloth 70 last in one pattern section. "X" moves with the embroidery frame 4.

FIG. 42B shows the embroidery frame 4 that is moved to a moving limit position within the embroidery frame moving area 38 so that the hollow needle 81 moves to a furthermost position from the last stitch position through the movement of the embroidery frame 4. FIG. 42C shows the embroidery frame 4 that is moved to a furthermost moving limit position with respect to a frame detaching position shown by a double dashed chain line within the embroidery frame moving area 38.

Figure 43:
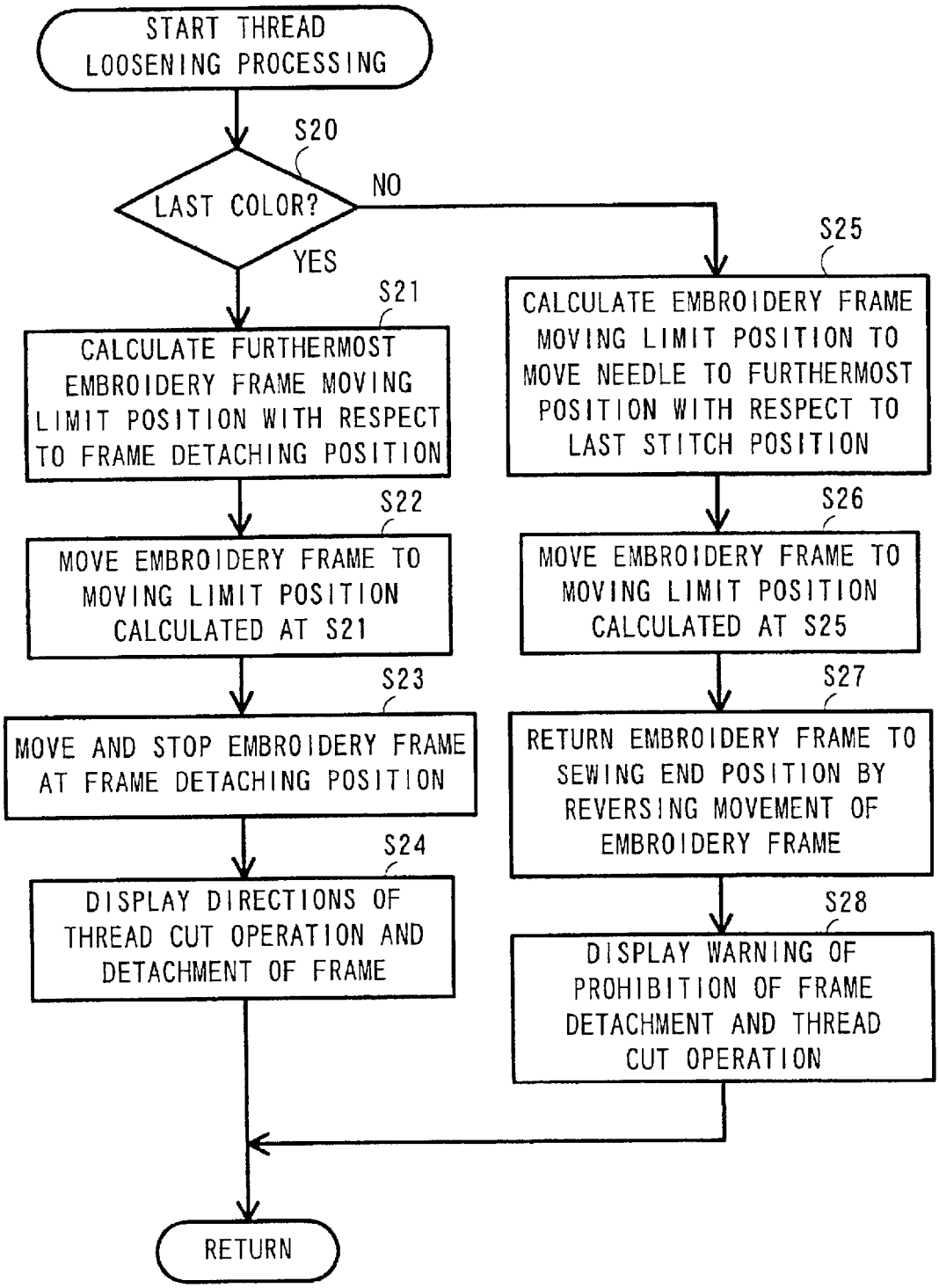
FIG. 43 is a flowchart of thread loosening control to be executed in the sewing apparatus.

As shown in FIG. 43, when the thread loosening process of S17 is started, it is determined whether the thread being used is for a last pattern section (S20). When the thread being used is for the last pattern section (S20;Yes), that is, when all pattern sections of the embroidery pattern are formed, as shown in FIG. 42C, a moving limit position which is a furthermost position with respect to the frame detaching position (shown by a double dashed chain line) of the embroidery frame 4 is calculated (S21). Based on the calculated data, the embroidery frame driving mechanism 11 is controlled so that embroidery frame 4 is moved to the moving limit position (S22).

Accordingly, the thread 99 is drawn from the spool 82 in the sewing cartridge 5. Next, the embroidery frame 4 is moved and stopped at the frame detaching position (S23), and the thread 99 extending between the work cloth 70 and the hollow needle 81 is loosened. Then, directions of thread cut operation and detachment of the embroidery frame 4 are displayed on the display 8 via the game machine 6 (S24). When the embroidery frame 4 is moved to the frame detaching position, the carriage 18 is moved to the foremost position and is positioned under the oscillating arm 40.

When the thread being used is not for the last pattern section (S20;No), that is, when all the pattern sections of the embroidery pattern are not formed, a moving limit position of the embroidery frame 4 is calculated so that the hollow needle 81 is moved to a furthermost position with respect to a last stitch position (S25). For example, when a sewing end position of the embroidery frame 4 is a position shown in FIG. 42A, the embroidery frame 4 is moved to a position shown in FIG. 42B. Based on the calculated data, the embroidery frame driving mechanism 11 is controlled so that the embroidery frame 4 is moved to the moving limit position (S26).

Accordingly, enough thread 99 is drawn from the spool 82 in the sewing cartridge 5. Next, the embroidery frame 4 is returned to the sewing end position by which the movement of the embroidery frame 4 is reversed (S27). The thread 99 extending between the work cloth 70 and the hollow needle 81 is loosened. Then, a warning of prohibition of detachment of the embroidery frame 4 and directions of thread cut operation are displayed on the display 8 via the game machine 6 (S28).

When S22, S23, S26 and S27 are performed, as described above, the thread 99 extending between the hollow needle 81 and the work cloth 70 is loosened. The thread 99 is cut at S24 and S28 according to the directions of the thread cut operation displayed on the display 8. At that time, the thread 99 can be easily manually cut without removing the safety cover 3 from the sewing apparatus body 2 while the embroidery frame moving area 38 of the embroidery frame 4 is covered with the safety cover 3. For example, a pair of scissors is inserted into the inside of the safety cover 3 from the embroidery frame insertion slot 3*f*. While the inside of the safety cover 3 is observed from the outside of the safety cover 3, made of a transparent or translucent material, the thread 99 can be easily cut using the scissors.

Next, when the sewing operation of the embroidery pattern has been completed, that is, when S21 to S24 have been performed, the embroidery frame 4 located in the frame detaching position can be easily detached from the sewing apparatus body 2 according to the directions of detachment of the frame displayed on the display 8. When the embroidery frame 4 is in the foremost position within the embroidery frame moving area 38, that is, in the frame detaching position, the carriage 18 is positioned substantially under the oscillating arm 40. After the work cloth 70 on which the embroidery pattern is formed is removed from the embroidery frame 4, as shown in FIG. 37, the double-sided adhesive tape 77 is adhered to the reverse side of the work cloth 70 and thus, a patterned cloth 78 is obtained. The patterned cloth 78 can be adhered to various kinds of things via the double-sided adhesive tape 77.

When the sewing of the embroidery pattern has not been completed, that is, when S25 to S28 have been performed, the sewing cartridge 5 is changed to another sewing cartridge 5 accommodating a thread 99 to be used for a next pattern section after thread cutting. After that, as the start/stop switch 16 is turned on at S13, processing at S14 and subsequent processing are performed again. After the sewing operation is completed, the safety cover 3 is moved to the storage position. Then, the embroidery frame 4 can be detached from the embroidery frame insertion slot 3*f*.

As described above, according to the sewing apparatus 1, a desired embroidery pattern can be selected/edited from various kinds of embroidery patterns using the game machine 6. A selected/edited embroidery pattern can be sewn on a work cloth 70 attached to the embroidery frame 4. Further, a colorful embroidery pattern can be sewn using threads having different colors in several pattern sections forming the embroidery pattern. The work cloth 70 on which the embroidery pattern is sewn is removed from the embroidery frame 4 and is adhered with the double-sided adhesive tape 77. Thus, a patterned cloth 78 is obtained and can be attached to various items as an emblem.

While the sewing operation is performed, the embroidery frame moving area 38 can be covered with the safety cover 3 in the sewing position. Most of the sewing cartridge 5 including the hollow needle 81, and the oscillating arm 40 can be also covered by the safety cover 3. The safety cover 3 cannot be removed from the sewing apparatus body 2. In positions other than the sewing position, the safety cover 3 prevents the start/stop switch 16 from being operated. Thus, the sewing apparatus 1 is prevented from an undesired operation occurring. Accordingly, the sewing apparatus 1 offers a superior level of safety and operability.

The sewing apparatus 1 is convenient to carry and store because the sewing apparatus 1 is compact and lightweight. The embroidery frame 4 and the sewing cartridge 5 can be easily attached to and detached from the sewing apparatus 1. In the sewing apparatus 1 the safety cover 3 can be easily switched in its position between the storage position and the sewing position to attach/detach the embroidery frame 4 and the sewing cartridge 5 thereto/therefrom. The thread 99 extending between the hollow needle 81 and the work cloth 70 can be easily cut. Accordingly, the sewing apparatus 1 can be easily handled and operated.

The sewing condition can be observed via the safety cover 3 made of a transparent or a translucent material, so that a user's interest will be raised. Accordingly, the sewing apparatus 1 can be easily handled by all users, for example, by children. Further, the sewing apparatus 1 offers a superior level of safety and operability. Because character emblems can be made by which desired characters are selected from game software and are embroidered on a work cloth, children will get a lot of pleasure from the sewing.

In the aforementioned embodiment, a desired embroidery pattern is selected from various kinds of embroidery patterns stored in the DVD 120 and pattern data of the desired embroidery pattern is sent to the sewing apparatus 1 using the game machine 6. However, image data of a character in game software may be provided to the sewing apparatus 1 using the game machine 6 and pattern data may be created in the sewing apparatus 1 based on the image data.

In the aforementioned embodiment, sewing data is supplied from the DVD 120, which is an external storage medium, via the home video game machine 6. However, sewing data may be supplied from other types of external storage mediums such as an optical recording medium (e.g., a CDROM, a CD-R), a magnetic recording medium (e.g. a floppy disk), and a semiconductor recording medium (e.g. a flash memory).

In the aforementioned embodiment, it is assumed that sewing data is stored in an external storage medium in advance. However, sewing data may be created by calculation of a CPU in the sewing apparatus body 2 or the game machine 6. For example, color image data of a game is divided by color and areas are specified by color. Then, the color-specific areas are specified as color-specific sewing areas. After that, sewing data for filling an area with Tatami stitches is created by color. Sewing data for stitching pattern sections so that boundary areas of the pattern sections overlap each other is created. Sewing data for stitching with Satin stitches as an outline of an embroidery pattern is created. A video capture function (a print screen function in a personal computer) can be used to capture image data as described above. A sequence of sewing of areas is determined based on size of areas and the lightness of the colors. However, an outline is preferably sewn last.

A data supply device connected to the sewing apparatus body 2 of the sewing apparatus 1 is not restricted to the home video game machine 6, but may be embroidery machines, computer sewing machines, radio-cassette players, satellite receiving tuners, karaoke terminals (including on-line and non on-line karaoke systems), facsimiles, cellar phones, televisions, videocassette recorders, music CD players, 8-millimeter video cameras, digital cameras, or computers, if the apparatus has a function of handling data. Data communications with the sewing apparatus body 2 may be implemented via a cable 401. However, wireless data communication (including infrared rays) may be implemented.

For example, when a satellite receiving tuner is used, main audio information is used in a commercial and the satellite receiving tuner receives data and programs for the sewing apparatus body 2 through sub-audio information, which is not used for audio of the commercial while the commercial of the sewing apparatus 1, a manufacturer of the sewing apparatus 1 or other products is being run. Sewing may be performed by which data and programs received by the satellite receiving tuner is processed and the sewing apparatus body 2 is controlled. Data may be supplied to the sewing apparatus body 2 via other equipment, such as the home video game machine 6.

When the sub-audio information is used, advertising effectiveness may be ensured by which it is structured that the data and programs received by the satellite receiving tuner can be used only when the data is played back at a normal playback speed, in which the recorded commercial is watched, in a case where image data is recorded using a videocassette recorder. When a sewing machine is used as a data supply device, sewing can be performed using patterns installed in the sewing machine or patterns supplied from an external storage medium to be attached to the sewing machine. Sewing data is edited using a display and operating members provided on the sewing machine.

In the aforementioned embodiment, the sewing apparatus body 2 of the sewing apparatus 1 is directly connected with the data supply device via the connecting cable. The sewing apparatus body 2 may be connected with the data supply device via a converter 400 so as to be connected with other equipment described above. The converter 400 may be dedicated to various equipment described above, or may have several types of connecting portions. If such a converter 400 is used, there is a possibility that a general-purpose cable for connection can be used. The sewing apparatus body 2 may be connected with one or more data supply devices, such as a second game machine 402, a third game machine 403, a data supply device 404 other than the game machine, and a sewing machine 405, at the same time. The converter 400 may contribute to only data transmission, or may be provided with a CPU so that data can be edited or converted in the converter 400.

In the aforementioned embodiment, because a patterned cloth, such as an emblem, is adhered to clothes using a double-sided adhesive tape, the patterned cloth can be easily attached to and detached from the clothes. Instead of the double-sided adhesive tape, hook-and-loop fasteners may be used. In a case where an emblem is attached to clothes via a double-sided adhesive tape or hook-and-loop fasteners, the emblem can be easily removed from the clothes when the clothes are washed.

Although the invention has been described in detail with reference to specific embodiments thereof, it would be apparent to those skilled in the art that various changes and modifications may be made therein without departing from the spirit of the invention.

What is claimed is:

1. A sewing apparatus where sewing is performed by causing a thread to remain in a workpiece, comprising:

a hollow needle that moves up and down to pass the thread into the workpiece;

a workpiece moving device that relatively moves the workpiece with respect to the hollow needle; and a holding member that presses at least a part of the thread connecting two consecutive stitch points to the workpiece in accordance with a relative movement between the hollow needle and the workpiece, wherein the holding member retains a part of the thread between one stitch point and a succeeding stitch point to prevent unraveling.

2. The sewing apparatus according to claim 1, wherein a distance between the hollow needle and the holding member is smaller than a minimum pitch between the two consecutive stitch points.

3. The sewing apparatus according to claim 1, wherein the holding member is made of a hollow member having an inside wall surface that forms a passing hole through which the hollow needle passes.

4. The sewing apparatus according to claim 3, where the inside wall surface has a uniform wall thickness.

5. The sewing apparatus according to claim 4, wherein the holding member retains the thread at the wall thickness.

6. The sewing apparatus according to claim 3, wherein the holding member has a substantially circular shape.

7. The sewing apparatus according to claim 1, wherein the holding member is detachably attached to the sewing apparatus.

8. The sewing apparatus according to claim 1, wherein the holding member presses the workpiece between two consecutive stitch points.

9. The sewing apparatus according to claim 1, wherein the holding member is a presser foot.

10. A sewing cartridge for use with a sewing apparatus in which a thread is caused to remain in a workpiece by a thread holding force of the workpiece while sewing is performed by moving the workpiece, the sewing cartridge comprising:

a needle that can pass through the workpiece;

a thread storage member that stores the thread to be supplied to the needle;

a thread guiding member that guides the thread in a thread passing route from the thread storage member to the needle;

a thread holding member that holds at least a part of the thread connecting two consecutive stitch points in accordance with a relative movement between the needle and the workpiece.

11. The sewing cartridge according to claim 10, wherein the thread holding member has a needle passing hole through which the needle passes.

12. The sewing cartridge according to claim 11, wherein the thread holding member is formed in a substantially circular shape.

13. The sewing cartridge according to claim 12, wherein the thread holding member is made of a hollow member having an inside wall surface that forms the needle passing hole through which the needle passes.

14. The sewing cartridge according to claim 13, wherein the inside wall surface has a uniform wall thickness.

15. A sewing cartridge that forms a stitch point on a workpiece and is detachably attached to a sewing apparatus where sewing is performed by causing a thread to remain in the workpiece, comprising:

a needle that moves vertically and passes through the workpiece;

a needle cover that covers at least a tip of the needle;

a thread storage member that stores the thread to be supplied to the needle;

a thread guiding member that guides the thread from the thread storage member to the needle; and a presser foot that holds at least a part of the thread from a stitch point where a stitch has been made to a next stitch point where a stitch is being made.

16. The sewing cartridge according to claim 15, wherein the presser foot has a needle passing hole through which the needle passes.

17. The sewing cartridge according to claim 15, wherein the presser foot is made of a hollow member having an inside wall surface that forms the needle passing hole through which the needle passes.

18. The sewing apparatus according to claim 1, wherein the holding member is vertically movable.

19. The sewing apparatus according to claim 1, wherein the holding member is retractably positioned over the tip of the hollow needle.

20. A sewing apparatus where sewing is performed by causing a thread to remain in a workpiece, comprising:

a hollow needle that moves up and down to pass the thread into the workpiece;

a workpiece moving device that relatively moves the workpiece with respect to the hollow needle; and a holding member that presses at least a part of the thread connecting two consecutive stitch points in accordance with a relative movement between the hollow needle and the workpiece, wherein the holding member is vertically movable, and the holding member retains a part of the thread between one stitch point and a succeeding stitch point to prevent unraveling, and the part of the thread being held is less than the entire amount of thread between stitch points.

21. A sewing apparatus where sewing is performed by causing a thread to remain in a workpiece, comprising:

a hollow needle that moves up and down to pass the thread into the workpiece; a workpiece moving device that relatively moves the workpiece with respect to the hollow needle; and a holding member that presses at least a part of the thread connecting two consecutive stitch points in accordance with a relative movement between the hollow needle and the workpiece, wherein the holding member is retractably positioned over the tip of the hollow needle, and the holding member retains a part of the thread between one stitch point and a succeeding stitch point to prevent unraveling, and the part of the thread being held is less than the entire amount of thread between stitch points.

* * * * *